US009376800B2

(12) United States Patent
Martyn

(10) Patent No.: US 9,376,800 B2
(45) Date of Patent: Jun. 28, 2016

(54) FOLDABLE BUILDING

(71) Applicant: Ten Fold Engineering Limited, Buckinghamshire (GB)

(72) Inventor: David Martyn, Bath (GB)

(73) Assignee: Ten Fold Engineering Limited (GB)

( * ) Notice: Subject to any disclaimer, the term of this patent is extended or adjusted under 35 U.S.C. 154(b) by 0 days.

(21) Appl. No.: 14/426,417

(22) PCT Filed: Aug. 21, 2013

(86) PCT No.: PCT/GB2013/000351
§ 371 (c)(1),
(2) Date: Mar. 6, 2015

(87) PCT Pub. No.: WO2014/037690
PCT Pub. Date: Mar. 13, 2014

(65) Prior Publication Data

US 2015/0218794 A1 Aug. 6, 2015

(30) Foreign Application Priority Data

Sep. 6, 2012 (GB) ..... 1215935.6

(51) Int. Cl.
*E04B 1/343* (2006.01)
*E04B 1/344* (2006.01)

(52) U.S. Cl.
CPC ..... *E04B 1/34357* (2013.01); *E04B 1/3441* (2013.01); *E04B 1/3444* (2013.01); *E04B 1/3445* (2013.01); *E04B 1/34384* (2013.01); *E04B 2001/34389* (2013.01)

(58) Field of Classification Search
CPC ..... E04B 1/343; E04B 1/34357; E04B 1/344; E04B 1/3441; E04B 1/3445; E04B 1/34384; E04B 2001/34389
USPC ..... 52/66, 68, 69, 71, 79.5
See application file for complete search history.

(56) References Cited

U.S. PATENT DOCUMENTS 2,920,920 A * 1/1960 Couse ..... B60P 3/34 296/176
3,107,116 A * 10/1963 Meaker ..... B60P 3/34 296/171

(Continued)

FOREIGN PATENT DOCUMENTS

WO 8908754 A1 9/1989

OTHER PUBLICATIONS

International Search Report, PCT Application No. PCT/GB2013/000351 mailed Mar. 13, 2014, 4 pages.

*Primary Examiner* — Brian Glessner
*Assistant Examiner* — Adam Barlow
(74) *Attorney, Agent, or Firm* — Jason Saunders; Arnold, Knobloch & Saunders, L.L.P.

(57) ABSTRACT

An expandable building assembly is provided, the building assembly having a retracted condition, in which the roof of the building has a first area, and an extended condition, in which the roof of the building has a second area, the second area being greater than the first, the assembly comprising a roof portion; and means for displacing and rotating the roof portion between the retracted condition and the expanded condition; whereby in the retracted condition, the roof portion is in a first position and at a first orientation, and in the extended condition, the roof portion is in a second position and at a second orientation, wherein the second position is displaced from the first position and the second orientation is rotated with respect to the first orientation. A building comprising one or more of the building assemblies is also provided.

20 Claims, 10 Drawing Sheets

(56) References Cited

U.S. PATENT DOCUMENTS

Figure 1A:
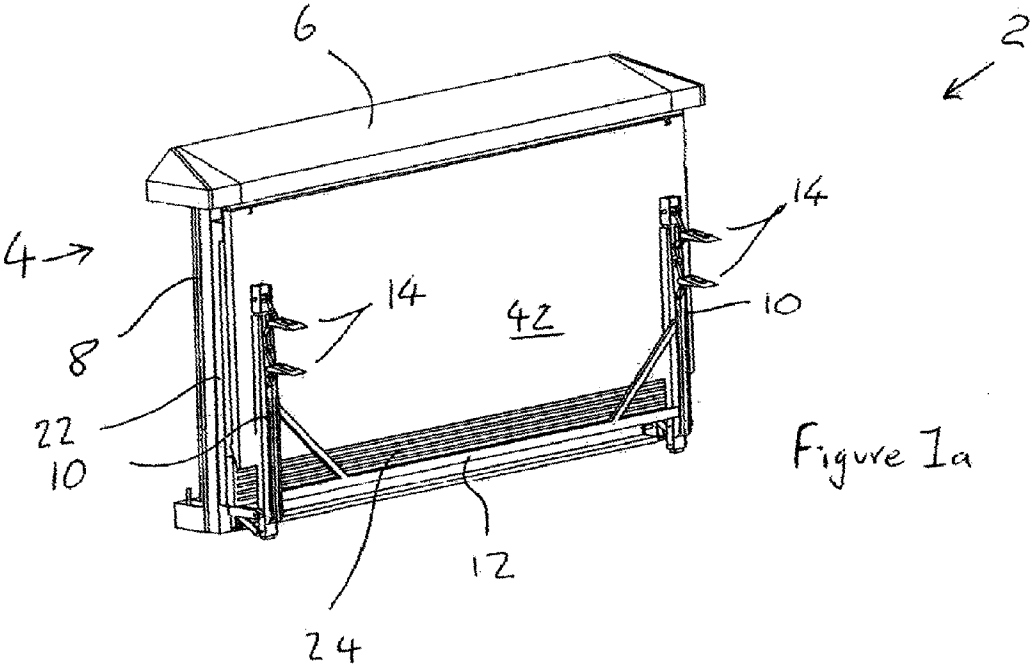

| | | | | | |
|---|---|---|---|---|---|
| 3,460,297 | A | | 8/1969 | Fritz | |
| 3,462,891 | A | * | 8/1969 | Smith | E04B 1/3444 52/18 |
| 3,653,165 | A | * | 4/1972 | West | E04B 1/3442 52/121 |
| 4,545,171 | A | * | 10/1985 | Colvin | E04B 1/3442 52/71 |
| 4,780,996 | A | * | 11/1988 | Julien, Jr. | E04B 1/3444 52/68 |
| 6,223,479 | B1 | * | 5/2001 | Stockli | E04B 1/3442 52/126.1 |
| 7,117,645 | B2 | * | 10/2006 | Bzorgi | E04B 1/3442 52/68 |
| 7,841,136 | B2 | * | 11/2010 | Czyznikiewicz | E04B 1/3444 52/64 |
| 8,201,362 | B2 | * | 6/2012 | Alford | E04B 1/3442 52/64 |
| 8,286,391 | B2 | * | 10/2012 | Yang | E04B 1/3444 52/64 |
| 2011/0056146 | A1 | | 3/2011 | Appert | |

* cited by examiner 2
24
22
42
6
62
46
62
60
48
30
8
4

24
60
22
36
38
102
42
34
32
2
6
4
8
48
30

FOLDABLE BUILDING

The present invention relates to a foldable building assembly and means for transporting and deploying the same. More particularly, the building assembly provides a means for providing a structure with a roof or expanding the roof of a building. The building assembly of the present invention is suitable for being transported by road.

House design and building methods are traditionally the result of evolution and the use of local materials. Site-built houses are the most basic example with most value being added by locally applied labour. Such houses seek to be durable and to be maintainable. Traditionally such houses are intended to provide shelter and, in recent years, to make increasingly efficient use of energy and other resources.

More recently, pre-fabrication of the key components of such houses has introduced production line techniques to house building, often in the form of panel builds and complete roof cassettes. This has now been extended to volume build methods, whereby the whole building, albeit on linkable modular form, is constructed away from the site and transported to the site for erection and installation. In parallel to this mainstream house building sector, the mobile/static home (park home) has often been used because of its comparatively low cost and ease of deployment. Such houses are generally placed in close juxtaposition and are neither durable nor easily financed.

As the cost of housing in many countries continues to rise, the ability of buyers to raise adequate resources to purchase a house has continued to fall. As a result there are whole sectors of communities which are unable to own property or even to find affordable rental properties, especially in convenient locations. In order to address this problem, it is necessary to make available to such sectors housing which offers the quality of a built home while maintaining the overheads structure of a park home. Such a design, if it can be made durable and repairable, will retain its value and may be relocated at any time onto more suitable or more available land.

There is a need for an improved design of building that is cost effective to construct and erect. Preferably, the building is formed from an assembly that can be easily transported, most preferably by road, to the site and erected or deployed with minimum time and effort.

Building structures have one or more collapsible or folding sections are known in the art. Examples of such assemblies are disclosed in the following:

U.S. Pat. No. 3,360,891 discloses an extendable portable house. The building comprises a floor, a roof and a plurality of walls, of largely conventional arrangement. To allow the building to be expanded, a wall is provided with a foldable floor member for providing the floor of the expanded portion of the building, the foldable floor member being hingedly attached to the building and able to fold down from a vertical position to a horizontal position. Foldable wall members are provided comprising a plurality of hingedly attached panels. The wall members are hingedly attached to the floor member. A moveable covering member forms part of the wall of the building, when in the collapsed condition, and a covering for the expanded portion of the building.

U.S. Pat. No. 3,383,880 concerns a folding house trailer. The trailer comprises box-like end sections pivotably mounted to the floor of the trailer. The end sections when folded nest within each other. The end sections when extended form the end portions of the building. Foldable side walls and a foldable roof are provided, which nest within the end sections, when in the folded state, and can be extended to complete the side walls and roof between the extended end sections.

A foldable mobile house is described and shown in U.S. Pat. No. 3,862,526. The house is provided collapsed into a conventional trailer box-like shape for transportation by road. The house comprises components for being unfolded to form an A-frame construction. In particular, the house comprises a base support structure forming a floor member. A foldable floor extension structure is provided with a hinge member, allowing the floor extension to move in a place parallel to the base. A plurality of side wall members are provided which, in the transportable position lie perpendicular to the base and, in the deployed position, lie at an angle to the base to form an A-frame configuration. Seals are provided along the edges of the side wall members.

U.S. Pat. No. 3,983,665 discloses a foldable and transportable building. The building is provided in two folded assemblies, each forming one half of the completed building. The building comprises side walls, foldable end walls and foldable roof sections. In their unfolded position, these sections form a saw-tooth configuration.

An expandable mobile building is also disclosed in U.S. Pat. No. 4,155,204. The building is transportable in its collapsed state, in particular forming a trailer for an articulated vehicle. The building comprises a central, generally rectangular container body, from which booms may be extended to provide means to deploy the building into its extended state and provide support for the walls and roof members. Floor, roof and wall sections are provided in a collapsed state vertically at the sides of the container. These sections are extended laterally of the container and are supported by the booms. Additional support is provided by legs extending from the outermost wall sections to the ground, when the building is fully extended.

U.S. Pat. No. 4,653,412 discloses a similar foldable building transportable in the form of a stackable container. The container may be deployed from its trailer after transportation to the site by means of jacks. A plurality of foldable, hinged members are held in a vertical orientation within the container in the collapsed state. These members are deployed from the sides of the container to form the floor, side walls and roof of the building. Booms extending from the container are used to deploy the structure.

A transportable modular house is described and shown in U.S. Pat. No. 5,094,048. The house is of a fixed construction and is transportable on a trailer. A rotatable bearing is mounted between the house and the trailer, allowing the house to rotate with respect to the trailer. Each corner of the house is provided with an extensible supporting member for raising and lowering the house onto the trailer for transportation. The house is generally elongate in shape and the trailer is first introduced under the house in a transverse orientation. The support members are raised, lowering the house onto the trailer. The bearing is use to rotate the house to align with the trailer, for transport by road.

U.S. Pat. No. 5,170,901 discloses a transportable construction element in the form of a container. The container comprises a hinged panel moveable between a closed position, in which the panel extends vertically at the side of the container, and an open position, in which the panel extends horizontally from the floor of the container. An internal structure comprising an upper or roof panel, a front panel and two side panels is moveable between an inserted position, in which it lies within the container, and an extended position, in which it lies on the hinged panel, with the hinged panel forming a floor for the internal structure. A container may comprise two such assemblies, one extendable from each side of the container.

An expandable/retractable portable structure is shown and described in U.S. Pat. No. 5,265,394. In its retracted position, the structure is able to be transported on public highways. The structure comprises a stationary or fixed portion and a moveable portion. The moveable portion is pivotally attached to the fixed portion. In the retracted position, the moveable portion encloses the fixed portion. In the expanded position, the moveable portion and stationary portion together provide the structure. A winch is provided to move the moveable portion between the expanded and retracted positions. In particular, the moveable portion comprises three sections, the first section forming a floor member in the expanded position and overlying a side of the stationary portion in the retracted position. The second section forms a wall when expanded and overlies the roof of the stationary portion, when retracted. Finally, the third section of the moveable portion forms a roof when expanded and overlies and encloses the opposing side of the stationary portion when retracted.

A foldable portable building is described and shown in U.S. Pat. No. 5,596,844. The building is arranged to collapse and fit within a internationally standardised goods container. The building comprises a plurality of roof, floor and wall members arranged to fold into the container, so as to lie vertically therewithin. The roof and floor members lie outermost and are extendible to form the floor and roof of the building. A plurality of wall members are interconnected so as to extend in a concertina manner from within the container, to complete the building.

ES 2310085 discloses a movable unit for washing vehicles. The unit has a frame, a platform and a body. The body has movable side panels. Means are provided to move the side panels between an open and a closed position.

EP 1 054 113 discloses a compact shelter. A side wall portion of the shelter is movable between a position of minimum hindrance and an access position. A movable door panel is also provided in the shelter.

A telescopically expanding garage assembly is described and shown in CN 201031510.

Finally, a mobile expandable structure for providing accommodation is disclosed in WO 96/13402.

There is a general need for an improved assembly for reversibly expanding the volume of a structure, in particular a building. For example, there is a need for an improved arrangement of foldable building assembly, which is simple to construct, can be transported by road to the required location, is simple and quick to deploy and provides sufficient accommodation when extended. It would also be useful if the assembly could have more general applications and be used in a wide variety of moveable and stationary buildings and installations.

In a first aspect, the present invention provides an expandable building assembly, the building assembly having a retracted condition, in which the roof of the building has a first area, and an extended condition, in which the roof of the building has a second area, the second area being greater than the first, the assembly comprising:

a roof portion; and means for displacing and rotating the roof portion between the retracted condition and the expanded condition;

whereby in the retracted condition, the roof portion is in a first position and at a first orientation, and in the extended condition, the roof portion is in a second position and at a second orientation, wherein the second position is displaced from the first position and the second orientation is rotated with respect to the first orientation.

In a further aspect, the present invention provides a method of changing the roof of a building between a retracted condition, in which the roof has a first area, and an expanded condition, in which the roof has a second area, the second area greater than the first area, the method comprising:

providing a roof portion of the building having a first position and a first orientation in the retracted condition and a second position and a second orientation in the expanded condition;

wherein when in the second position the roof portion is displaced from its first position and when in the second orientation the roof portion is rotated relative to its first orientation;

the method comprising displacing the roof portion between the first position and the second position and rotating the roof portion between the first orientation and the second orientation.

References herein to a 'building' are references to any structure that requires a temporary or permanent roof, part or all of the roof being provided by the roof portion of the assembly. The building may be a permanent structure. Alternatively, the building may be a temporary structure.

The assembly of the present invention comprises a roof portion that may be deployed between an extended condition and a retracted condition. In the extended position, the roof portion provides the building with a roof. In one embodiment, the roof portion forms the roof of the building. In an alternative embodiment, the roof portion increases the area of a pre-existing roof of the building. In such a case, the roof portion may be contiguous with the pre-existing roof of the building or may provide an additional but separate roof area.

The roof portion has a major surface that is presented uppermost when the roof portion is in the extended position and forms the outer surface of the roof. The roof portion of the assembly of the present invention is a rigid structure. The roof portion may be formed with any suitable rigid arrangement. The roof portion is preferably of a light weight construction, allowing it to be easily moved and positioned.

The roof portion of the assembly of the present invention is moveable between a retracted condition and an extended condition. The roof portion may simply be moveable from the retracted condition to the extended condition. More preferably, the assembly is such that the roof portion is reversibly moveable between the retracted condition and the extended condition, in particular being moved from each of the retracted condition and the extended condition to the other a plurality of times.

A building comprising the assembly will have a first shape when the roof portion of the assembly is in the retracted condition and a second shape when the roof portion is in the extended condition. The roof of the building has a perimeter, the length of the perimeter being greater with the roof portion in the extended condition than the length of the perimeter with the roof portion in the retracted condition. The roof of the building in the retracted condition may be considered to have a footprint, that is the area on the ground below the building defined by the perimeter of the roof when the assembly is in the retracted condition.

In the retracted condition, the roof portion is in a first position and in a first orientation. The first position may be any suitable position relative to the building. When in the first position, the roof portion may lie outside the footprint of the roof of the building. More preferably, when in the first position, the roof portion lies within the footprint of the roof of the building. For example, the roof portion in the first position may form part of the roof of the building. Alternatively, in the first position the roof portion may lie within the interior of the building.

In one embodiment, the roof portion when in the first position does not form part of the roof of the building, but forms another part of the structure of the building. In particular, in one preferred embodiment, the roof portion forms a wall of the building or a portion of a wall of the building, in particular an external wall or part thereof. Preferably, in this embodiment, the surface of the roof portion forming the upper surface when in the second position forms an outer surface of a wall of the building when the roof portion is in the first position.

In the retracted condition, the roof portion may be in any suitable orientation. Preferably, the roof portion is oriented to extend at an acute angle to the vertical, more preferably less than 45° to the vertical, still more preferably less than 30° to the vertical, especially less than 20° to the vertical. In one preferred embodiment, the roof portion is oriented substantially vertically when in the retracted condition.

In the extended condition, the roof portion is both displaced from the first position to a second position and rotated with respect to the first orientation to a second orientation. In the second position, the roof portion forms the roof of the building or a part thereof. In the second position, the roof portion may be in any position relative to the first position. In a preferred embodiment, when in the second position, the roof portion is outside the enclosure of the building when in the retracted condition.

In the extended condition, the roof portion may be in any suitable orientation to form a roof of the building or a portion thereof. Preferably, the roof portion is oriented to be horizontal or substantially horizontal. Alternatively, the roof portion may extend at an angle to the horizontal, preferably less than 45° to the horizontal, more preferably from 10 to 40°, still more preferably from 15 to 30° to the horizontal.

The assembly of the present invention both displaces and rotates the roof portion when moving between the retracted and the extended conditions. When in the retracted condition, the roof portion may be contiguous with other parts of the building. Alternatively, the roof portion may be spaced from the other parts of the building. More preferably, the roof portion forms a wall or part thereof or part or all of the roof of the building, as noted hereinbefore.

When in the extended condition, the roof portion may be contiguous with the other parts of the building, as those parts are arranged with the assembly in the retracted condition. More preferably, when in the extended condition, the roof portion is displaced from the other parts of the building, as those parts are arranged with the assembly in the retracted condition. In such cases, it is particularly preferred that the assembly further comprises an intermediate portion. When the roof portion is in the extended position, the intermediate portion extends between the roof portion and the other parts of the building. In particular, the intermediate portion may be in a stowed position when the assembly is the retracted condition and in a deployed position when the assembly is in the extended condition, in the deployed position the intermediate portion extending between the roof portion and other parts of the building, as described above. In the stowed position, the intermediate portion is preferably within the footprint of the roof of the building when in the retracted condition, for example being stowed within the interior of the building. In one preferred embodiment, the intermediate portion forms an outer wall of the building or a part thereof when in the assembly is in the retracted condition.

In one preferred embodiment, the roof portion and the intermediate portion are arranged to interlock when in the extended position. For example, the intermediate portion and the roof portion may interlock along their opposing edges or edge portions. In this way, the roof formed by the intermediate portion and the roof portion may be rigidly formed and be watertight.

In one embodiment, the intermediate portion is pivotally mounted along one edge to the structure of the building. The action of the roof portion moving between the retracted and extended conditions moves the intermediate portion about its pivot mounting. In particular, the roof portion may bear on the intermediate portion, whereby movement of the roof portion causes the intermediate portion to move. The roof portion may be in sliding contact with the intermediate portion. More preferably, one or more wheels, rollers or the like are provided between the roof portion and the intermediate portion, to reduce the resistance to motion of the two components.

The assembly of the present invention may further comprise one or more wall portions. The or each wall portion is moveable between a stowed position, when the building assembly is in the retracted condition, and a deployed position, when the building assembly is in the extended condition. Preferably, the assembly comprises sufficient wall portions for the assembly to form a complete enclosure with the roof portion when in the extended condition, more preferably to thereby increase the interior volume of the building.

The or each wall portion may be stowed in any suitable position and orientation. Preferably, the or each wall portion is arranged to unfold from the stowed position to the deployed position. More particularly, the or each wall portion is arranged to pivot about an edge thereof, for example by means of one or more hinge assemblies, preferably about a vertical edge of the wall portion.

Similarly, the assembly of the present invention may further comprise a floor assembly having one or more floor portions. The or each floor portion is moveable between a stowed position, when the building assembly is in the retracted condition, and a deployed position, when the building assembly is in the extended condition. Preferably, the assembly comprises sufficient floor portions for the assembly to form a complete floor beneath the roof portion and, if present, the intermediate portion, when in the extended condition, more preferably to thereby increase the area of the floor of the building.

The or each floor portion may be stowed in any suitable position and orientation. Preferably, the or each floor portion is arranged to unfold from the stowed position to the deployed position. In one embodiment, the or each floor portion is pivotable about an edge thereof, preferably a horizontal edge thereof. Preferably, the or each floor portion lies within the footprint of the building when in the stowed position, more preferably on the interior side of the roof portion when stowed. In a preferred embodiment, the or each floor portion is arranged to be vertical or substantially vertical when in the stowed position in the retracted condition. In one embodiment, a plurality of floor portions are provided, with each floor portion being hingedly attached to one or more adjacent floor portions along an edge thereof.

In one preferred embodiment, the assembly further comprises one or more support members for supporting components of the assembly, in particular when in the extended condition. More preferably, each support member is moveable between a retracted position and an extended position. In one embodiment, each support member is pivotally mounted to move between the retracted and extended positions. In one preferred embodiment, the or each support member is in a vertical or substantially vertical orientation when in the retracted position. Preferably, the or each support member is substantially horizontal when in the extended position.

The support member may have any suitable form able to provide support to components of the assembly. Preferably, each support assembly comprises a beam. In one embodiment, the beam comprises a plurality of beam sections, preferably the beam sections being arranged telescopically.

In a preferred embodiment, the support member when in the extended position provides support for one or more floor portions and/or one or more wall portions.

As noted above, in use, the roof portion of the building assembly of the present invention is moved from the retracted condition to the extended condition by being both displaced and rotated. In one preferred embodiment, the pattern of movement of the roof portion is such that the distal edge of the roof portion, that is the edge of the roof portion that is outermost when the roof portion is in the extended condition, is moved in a first motion in a substantially straight line and, thereafter, in a second motion in an arc. This pattern of motion is particularly preferred when the roof portion has its distal edge lowermost, when in the retracted position. Preferably, the distal edge is moved along and in contact with a support structure during the first motion. Means, such as one or more wheels or rollers, may be provided to reduce the resistance to movement of the distal edge of the roof portion along the support structure.

The assembly of the present invention further comprises means to displace and rotate the roof portion between the retracted condition and the extended condition. Any suitable means may be employed to move the roof portion. For example, the roof portion and other portions of the assembly may be moved by means of an arrangement of cables and/or levers. Drive to the means for moving the roof portion may be any suitable means, for example one or more electric motors. Alternatively, drive for moving the roof portion and other components of the assembly may be provide manually, for example directly to the components or by way of a drive mechanism, such as a jack, screw or the like. The roof portion and other components of the assembly may be moved singly or two or more components may be moved together, simultaneously by the drive means.

In one preferred embodiment, two or more components of the assembly are interconnected, such that movement of one component results in a corresponding movement of one or more further components of the assembly. For example, one component, such as a component of the floor or a wall, may be interconnected to the roof portion, whereby movement of the component causes the roof portion to move and vice-versa. In a particularly preferred arrangement, it has been found that two or more components may be interconnected in this manner so as to be partially or wholly counterbalanced. More particular, gravity may be used to at least partially counterbalance two or more interconnected components, thereby significantly reducing the power required to move the components. In a particularly advantageous embodiment, the roof portion is interconnected to and at least partially counterbalanced by one or more other components, in particular a floor panel. In this arrangement, the floor panel may be arranged to be stowed in a generally vertical position. Movement of the floor panel from its stowed position under the action of gravity to its deployed, horizontal position, may be used to move the roof portion, in particular to raise the roof portion. Similarly, the action of the roof portion being lowered under the action of gravity may be used to raise the floor panel from its deployed position to its stowed position. The extent to which components, such as the roof portion and the floor panels, may be counterbalanced in this manner is determined by their relative weights. Components may be selected according to their weight to be interconnected and better counterbalanced. Alternatively, the weight of one component, for example a floor panel, may be adjusted to provide an effective counterbalancing of another component, for example to allows the roof portion to be displaced and raised with a minimum of additional work. In this way, the entire assembly may be arranged to be powered largely or substantially wholly manually. The interconnection between the two or more components may be direct or may be indirect, for example by way of one or more pivoted arms and/or levers.

In one preferred embodiment, the means for moving the roof portion comprises an assembly of levers. More preferably, an assembly of the general type described and shown in pending GB patent application No. 1209982.6 is employed, general details of which are as follows:

The lever assembly for providing motion to the roof portion and, if required, other components of the building assembly of the present invention relies upon an arrangement of five levers or arms having pivoted connections therebetween. The lever assembly comprises:

a first arm rotatable at a first position thereon about a first fixed pivot;

a second arm rotatable at a first position thereon about a second fixed pivot, the second fixed pivot spaced apart from the first fixed pivot;

a third arm pivotably connected at a first position thereon to the second arm at a second position on the second arm, the second position spaced apart from the first position on the second arm;

a first connecting arm extending between the first arm and the third arm, the first connecting arm pivotably connected to a second position on the first arm spaced apart from the first position and pivotably connected to the third arm at a second position thereon spaced apart from the first position thereon; and a second connecting arm extending between the first arm and the second arm, the second connecting arm pivotably connected to a third position on the first arm disposed between the first and second positions thereon and pivotably connected to a third position on the second arm at a third position thereon.

In operation of the lever assembly, rotation of the first arm about the first fixed pivot results in rotation of the second arm about the second fixed pivot and movement of the third arm. In particular, the third arm is caused to move such that a point on the third arm (herein referred to as 'the said point') spaced from the first position on the third arm and located such that the second position on the third arm lies between the said point and the first position moves in a straight line. Thus, rotational motion of the first arm and the second arm about their respective fixed pivots results in a straight line motion of the said point on the third arm. In this respect, it is to be noted that the said point on the third arm referred to traces a line that is substantially straight, that is represents a very close approximation to a straight line. In particular, the path followed by the said point may be characterised as being a very flat sine wave, that is a sine wave of high wavelength and very low amplitude.

The point on the third arm referred to above is spaced from the first position on the third arm, with the second position on the third arm lying between the said point and the first position. The location of the said point will depend upon the length of the arms of the device and the positions of their interconnections. The roof portion may be connected to the third arm of the lever assembly. More particularly, the roof portion is mounted to the third arm so as to be parallel therewith. Alternatively, the roof portion may form the third arm of the lever assembly.

In one preferred embodiment, the said point is arranged to be at the distal edge of the roof portion. In this way, the distal edge of the roof portion is caused to move from the retracted condition first by moving in a straight line path, preferably horizontally.

The arrangement of the lever assembly may be varied depending upon the requirements for the movement of the roof portion. For example, the assembly may be arranged to provide a longer straight line movement of the said point on the third arm with a slightly greater deviation from a straight line. Alternatively, the assembly may be arranged to provide a shorter straight line movement of the said point, with the path traced by the said point being a closer approximation to a straight line with less deviation.

The arms of the lever assembly may be constructed such that the arms may be accommodated one within another. The components of the assembly may be arranged such that, when in the retracted position, the first and second connecting arms are accommodated within or adjacent the first and second arms, thereby providing for a particularly compact assembly when in the retracted position.

The lever assembly has been described hereinbefore by reference to a plurality of arms. It is to be understood that the term 'arm' is used as a general reference to any component that may be connected as hereinbefore described and/or moved about a fixed pivot. Accordingly, the term 'arm' is to be understood as being a reference to any such component, regardless of shape or configuration.

As noted above, the lever assembly of the present invention provides a motion of the said point on the third arm, and hence the roof portion, that follows a straight line over a first portion of its movement. However, the operation of the assembly is not limited to this extent of movement of the third arm. Rather, continued movement of the assembly causes the third arm to move to a position that is rotated with respect to and displaced from the line joining the first and second fixed pivots. This movement of the third arm away from the line joining the first and second fixed pivots with simultaneous rotation of the third arm provides both the required displacement and rotation of the roof portion in a single motion. The lever assembly allows the third arm, and hence the roof portion, to be moved to a position in which it extends at any desired angle to the line joining the first and second pivots.

The lever assembly comprises a first arm. The first arm may have any shape and configuration. A preferred form for the first arm is an elongate member, for example a bar or a rod. The first arm is pivotably mounted at a first position on the arm to a first fixed pivot. The first fixed pivot is mounted on the structure of the building. The pivotable connection at the first position may be of any suitable form, preferably a pin, spindle or axle passing through the arm about which the arm is free to move. The first position is preferably at or adjacent one end of the arm.

The first arm may function as a driving arm for the lever assembly, that is have a force applied thereto by the aforementioned drive means, so as to rotate the arm about the fixed pivot at the first position on the arm, thereby transferring drive to the other components of the lever assembly and the roof portion.

The first position on the first arm may be at any suitable location thereon. In one preferred embodiment, the first position is at or adjacent the first end of the first arm.

The assembly further comprises a second arm. The second arm may have any shape and configuration. A preferred form for the second arm is an elongate member, for example a bar or a rod. The second arm is pivotably mounted at a first position on the second arm to a second fixed pivot. Again, the second fixed pivot is mounted on the structure of the building. The pivotable connection at the first position may be of any suitable form, preferably a pin, spindle or axle passing through the arm about which the arm is free to move. The first position is preferably at or adjacent one end of the second arm.

The second arm may function as a driving arm for the assembly, that is have a force applied thereto by the aforementioned drive means, so as to rotate the arm about the fixed pivot at the first position on the arm, thereby transferring drive to the other components of the assembly. Alternatively, the second arm may be a driven arm of the assembly, that is move about the fixed pivot under the action of the other components of the assembly.

The lever assembly further comprises a third arm. The third arm may have any shape and configuration. A preferred form for the third arm is an elongate member, for example a bar or a rod. Alternatively, the third arm of the lever assembly is provided by the roof portion itself. The third arm is pivotably mounted at a first position on the third arm to the second arm. The pivotable connection between the second and third arms may be of any suitable form, preferably a pin, spindle or axle passing through the arms about which one or both of the arms are free to move.

The third arm is pivotably connected to the second arm at a first position on the third arm and a second position on the second arm. The first position may be in any suitable location on the third arm. In one preferred embodiment, the first position is at or adjacent one end of the third arm.

The second position on the second arm is spaced apart from the first position on the second arm. In one preferred embodiment, the second position on the second arm is at or adjacent the second end of the third arm.

The distance between the first and second fixed pivots and the lengths of the first, second and third arms may be selected according to the desired movement of the roof portion to be achieved.

However, generally, the ratio of the length of the first arm, that is the distance between the first and second positions on the first arm, to the distance between the first and second fixed pivots may range from 0.5 to 2.0, more preferably from 0.6 to 1.75, still more preferably from 0.75 to 1.5. The first arm is preferably shorter in length than the distance between the first and second fixed pivots. The ratio of the length of the first arm to the distance between the first and second fixed pivots is therefore more preferably from 0.75 to 0.99, still more preferably from 0.8 to 0.99, in particular from 0.9 to 0.99. A ratio of about 0.92 to about 0.98 is particularly suitable for many applications.

The ratio of the length of the second arm, that is the distance between the first and second positions on the second arm, to the distance between the first and second fixed pivots may range from 0.5 to 2.0, more preferably from 0.6 to 1.75, still more preferably from 0.75 to 1.5. The second arm is preferably shorter in length than the distance between the first and second fixed pivots. The ratio of the length of the second arm to the distance between the first and second fixed pivots is therefore more preferably from 0.75 to 0.99, still more preferably from 0.8 to 0.99, in particular from 0.9 to 0.99. A ratio of about 0.92 to about 0.98 is particularly suitable for many applications.

The length of the second arm is preferably selected to be as long as possible, within the constraints of the other components of the assembly and the desired motion. In this way, the arc through which the second position on the second arm moves about the second fixed pivot has as large a radius as possible. This facilitates the positioning of the second connecting arm.

The second arm may be longer or shorter than the first arm. In one preferred embodiment, the first and second arms are of the same length.

Taking the length of the third arm to be the distance between the first position on the third arm and the said point on the third arm, the length of the third arm will be determined by the arrangement of the first and second arms, together with the connecting arms. In some embodiments, the length of the third arm is less than that of the first and second arms, in particular from 0.9 to 0.99 of the length of the first and/or second arms. For example, with the first and second arms being of equal length and less than the distance between the first and second fixed pivots, the third arm has a length of about 0.975. In alternative embodiments, the length of the third arm is the same as that of the first arm and/or the second arm. In one particularly preferred arrangement, the first, second and third arms are the same length.

The lever assembly further comprises a first connecting arm. The first connecting arm extends between the first arm and the third arm. The first connecting arm may have any shape and configuration. A preferred form for the first connecting arm is an elongate member, for example a bar or a rod. The first connecting arm is pivotably mounted to each of the first and third arms. The pivotable connections between the first connecting arm and each of the first and third arms may be of any suitable form, preferably a pin, spindle or axle passing through the arms about which one or both of the arms are free to move.

The pivotable connections may be at any suitable location on the first connecting arm. In one preferred embodiment, the pivotable connection between the first connecting arm and the first arm is at or adjacent one end of the first connecting arm and/or the pivotable connection between the first connecting arm and the third arm is at or adjacent the second end of the first connecting arm.

The first connecting arm is connected to the first arm at a second position on the first arm. The second position on the first arm is spaced apart from the first position on the first arm. In one preferred embodiment, the second position on the first arm is at or adjacent the second end of the first arm.

The first connecting arm is further connected to the third arm at a second position on the third arm, which second position is spaced apart from the first position on the third arm.

The first connecting arm may have any suitable length. Its length is preferably the distance between the positions on the first and third arms between which the first connecting arm extends.

The second position on the third arm, at which the first connecting arm is connected, may be selected according to a number of factors. First, the first connecting arm acts to provide support for the third arm, in particular to assist in supporting any load applied to the third arm. The requirement for the third arm to be supported in this manner by the first connecting arm is a factor in determining the location of the second position on the third arm. Second, the overall strength and stability of the assembly is related to the length of the first connecting arm, with the strength and stability reducing as the length of the first connecting arm increases.

The second position on the third arm may be at any suitable position. In particular, the ratio of the distance between the first position and the second position on the third arm and the distance between the first position and the said point on the third arm may be from 0.1 to 0.9, more preferably from 0.2 to 0.8, still more preferably from 0.3 to 0.7, in particular from 0.35 to 0.6. A preferred ratio is from 0.4 to 0.55. The ratio of the distance between the first position and the second position on the third arm and the distance between the first position and the said point on the third arm is preferably less than 0.75, more preferably less than 0.65, more preferably less than 0.55. A ratio of up to 0.5 has been found to be particularly suitable. One particularly preferred embodiment of the assembly has the ratio of the distance between the first position and the second position on the third arm and the distance between the first position and the said point on the third arm about 0.41 to about 0.47.

The lever assembly further comprises a second connecting arm. The second connecting arm extends between the first arm and the second arm. The second connecting arm may have any shape and configuration. A preferred form for the second connecting arm is an elongate member, for example a bar or a rod. The second connecting arm is pivotably mounted to each of the first and second arms. The pivotable connections between the second connecting arm and each of the first and second arms may be of any suitable form, preferably a pin, spindle or axle passing through the arms about which one or both of the arms are free to move.

The pivotable connections may be at any suitable location on the second connecting arm. In one preferred embodiment, the pivotable connection between the second connecting arm and the first arm is at or adjacent one end of the first connecting arm and/or the pivotable connection between the second connecting arm and the second arm is at or adjacent the second end of the second connecting arm.

The second connecting arm is connected to the first arm at a third position on the first arm, which third position is spaced apart from and between both the first and second positions on the first arm.

The third position on the first arm, at which the second connecting arm is connected, may be selected according to a number of factors. First, the second connecting arm acts to provide support for the first arm, in particular to assist in supporting any load applied to the first arm. The requirement for the first arm to be supported in this manner by the first connecting arm is a factor in determining the location of the third position on the first arm. Second, as with the first connecting arm, the overall strength and stability of the assembly is related to the length of the second connecting arm, with the strength and stability reducing as the length of the second connecting arm increases.

The third position on the first arm may be at any suitable position. In particular, the ratio of the distance between the first position and the third position on the first arm and the distance between the first position and the second position on the first arm may be from 0.1 to 0.9, more preferably from 0.2 to 0.8, still more preferably from 0.3 to 0.7, in particular from 0.4 to 0.6. A preferred ratio is from 0.4 to 0.55. The ratio of the distance between the first position and the third position on the first arm and the distance between the first position and the second position on the first arm is preferably less than 0.75, more preferably less than 0.65, more preferably less than 0.55. A ratio of up to 0.5 has been found to be particularly suitable. One particularly preferred embodiment of the assembly has the ratio of the distance between the first position and the third position on the first arm and the distance between the first position and the second position on the first arm about 0.4 to 0.5.

The second connecting arm is further connected to the second arm at a third position on the second arm. In one embodiment of the assembly, the third position is spaced apart from and between the first and second positions on the second arm. In an alternative embodiment, the third position on the second arm coincides with the second position on the second arm, such that the second connecting arm is connected to both the second and third arms. This arrangement has the advantage of being particularly compact.

The third position on the second arm is at or spaced from the second position on the second arm and may be at any suitable position. In particular, the ratio of the distance between the first position and the third position on the second arm and the distance between the first position and the second position on the second arm may be from 0.8 to 1.0, more preferably from 0.85 to 1.0, still more preferably from 0.875 to 1.0, in particular from 0.9 to 1.0. A preferred ratio is from 0.925 to 1.0. One particularly preferred embodiment of the assembly has the ratio of the distance between the first position and the third position on the second arm and the distance between the first position and the second position on the second arm about 0.95 to 1.0.

The second connecting arm may have any suitable length. Its length is preferably the distance between the positions on the first and second arms between which the second connecting arm extends.

In a particularly preferred embodiment of the lever assembly, the lengths of the first, second and third arms, and first and second connecting arms are selected in accordance with the above criteria and to fold up when in the retracted position to lie between the first and second fixed pivots. It is a particular advantage that the assembly can be arranged to be in such a compact form when in the retracted position. In a preferred embodiment, the first, second and third arms and first and second connecting arms are formed with portions having 'I' and 'L' shapes in cross-section, with the portions being arranged to allow the arms to be accommodated within one another when in the retracted position.

A further lever assembly for use in the building assembly of the present invention is described and shown in pending GB patent application No. 1214929.0, general details of which are as follows:

The lever assembly for providing motion to the roof portion and, if required, other components of the building assembly of the present invention relies upon an arrangement of five levers or arms having pivoted connections therebetween. The lever assembly comprises:

a first arm rotatable at a first position thereon about a first fixed pivot;

a second arm rotatable at a first position thereon about a second fixed pivot, the second fixed pivot spaced apart from the first fixed pivot;

a third arm pivotably connected at a first position thereon to the second arm at a second position on the second arm, the second position spaced apart from the first position on the second arm;

a fourth arm pivotably connected at a first position thereon to the second arm at a third position on the second arm;

a first connecting arm extending between the first arm and the third arm, the first connecting arm pivotably connected to a second position on the first arm spaced apart from the first position and pivotably connected to the third arm at a second position thereon spaced apart from the first position thereon;

a second connecting arm extending between the first arm and the second arm, the second connecting arm pivotably connected to a third position on the first arm disposed between the first and second positions thereon and pivotably connected to a fourth position on the second arm at a third position thereon; and a third connecting arm extending between the first arm and the fourth arm, the third connecting arm pivotably connected to a fourth position on the first arm and pivotably connected to a second position on the fourth arm.

The lever assembly has first, second and third arms, and first and second connecting arms as generally described hereinbefore. In addition, the lever assembly has a fourth arm and a third connecting arm.

The fourth arm is connected to the second arm, as described above. In operation of the assembly, rotation of the first arm about the first fixed pivot results in rotation of the second arm about the second fixed pivot and movement of the fourth arm. In particular, the fourth arm is caused to move in a motion similar to that of the third arm, that is such that a point on the fourth arm (herein referred to again as 'the said point') spaced from the first position on the fourth arm and located such that the second position on the fourth arm lies between the said point and the first position moves in a straight line. Thus, rotational motion of the first arm and the second arm about their respective fixed pivots results in a straight line motion of the said point on the fourth arm. In this respect, it is to be noted that the said point on the fourth arm referred to traces a line that is substantially straight, that is represents a very close approximation to a straight line. In particular, the path followed by the said point on the fourth arm may be characterised as being a very flat sine wave, that is a sine wave of high wavelength and very low amplitude.

The said point on the fourth arm referred to above is spaced from the first position on the fourth arm, with the second position on the fourth arm lying between the said point and the first position. The location of the said point will depend upon the length of the arms of the device and the positions of their interconnections. In one preferred embodiment, the said point is arranged to be at a distal location on the fourth arm, that is distal from the first and second positions on the fourth arm, preferably with the said point being located at the free end of the fourth arm or in an end portion at the free end of the arm.

The extent of the straight line motion of the said point on the fourth arm varies according the precise positioning of the connections between the arms, as with the third arm described above. For example, in one embodiment, it has been found that this close approximation to a straight line motion by the said point on the fourth arm occurs over a distance that is up to 85% of the distance between the first and second fixed pivots. Further embodiments provide motion of the said point on the fourth arm that follows a close approximation to a straight line for a distance up to or exceeding 100% of the distance between the first and second fixed pivots. References herein to a motion of the said point on the fourth arm in a 'straight line' are references to this movement.

As noted, the said point on the fourth arm moves in a pattern that is a close approximation to a straight line. The deviation of the movement of the said point from a straight line may be exemplified by the following:

In an embodiment of the assembly in which the distance between the first fixed pivot and the second fixed pivot is 3250 mm, the said point on the fourth arm describes an approximate straight line of 2750 mm in length. In particular, the said point moves between a retracted position and a second extended position. In this respect, references to motion of the said point on the fourth arm are with respect to the line joining the first and second fixed pivots, with the retracted position being at or close to the line joining the first and second fixed pivots and the retracted position being distant therefrom. As noted, the said point on the fourth arm moves between the retracted position and the second extended position, with the line joining the retracted and second extended positions being a straight line substantially perpendicular to the line extending between the first and second pivots. However, in moving between the retracted and second extended positions, the said point follows a sine wave having a maximum deviation from the straight line of 8 mm. This deviation represents a deviation of just 0.25% of the distance travelled by the said point between the retracted and second extended positions and is generally insignificant in the context of most if not all practical applications of the assembly.

In another embodiment of the assembly in which the distance between the first fixed pivot and the second fixed pivot is 3250 mm, the said point on the fourth arm describes an approximate straight line of 3254 mm in length. In this embodiment, the deviation of the said point moves in a sine wave having a maximum deviation from a straight line of just 31.4 mm, that is just 0.96% of the distance travelled by the said point.

The arrangement of the assembly of the present invention may be varied depending upon the requirements. For example, the assembly may be arranged to provide a longer straight line movement of the said point on the fourth arm with a slightly greater deviation from a straight line. Alternatively, the assembly may be arranged to provide a shorter straight line movement of the said point, with the path traced by the said point being a closer approximation to a straight line with less deviation.

When moving between the retracted and the extended positions, the said point on the fourth arm follows a substantially straight line. Other points on the fourth arm follow a respective arc.

Continued movement of the assembly beyond the second extended position to a super-extended position causes the fourth arm to move to a position that is perpendicular to and displaced from the line joining the first and second fixed pivots. This movement of the fourth arm away from the line joining the first and second fixed pivots with simultaneous rotation of the fourth arm, once beyond the extended position, is also particularly useful, for example in deploying items connected to the fourth arm away from the line joining the first and second fixed pivots. Indeed, it has been found that, as with the third arm, the fourth arm may be moved to a position in which it extends at any desired angle to the line joining the first and second pivots, in particular up to and including perpendicular to the line. In addition, the fourth arm may be moved beyond the position perpendicular to the line joining the first and second pivots, if required.

It will be appreciated that the angle of the third arm with respect to the line joining the first and second pivots and the angle of the fourth arm with respect to the line joining the first and second pivots are different at each position of the assembly, once the assembly is moved from the retracted position.

As noted above, the motion of the third and fourth arms may be varied by the length of the other components of the assembly. The relative positions and angles of the third and fourth arms at different positions in the movement of the assembly from the retracted position may also be varied by appropriate selection of the length of the other components of the assembly.

In one particularly preferred embodiment, the assembly is arranged such that the said point on the fourth arm moves in a straight line, as described above, throughout the duration of the movement of the third arm from the retracted position to the super-extended position in which the third arm extends substantially perpendicular to the line joining the first and second pivots.

As noted above, the assembly further comprises a fourth arm. As with the first, second and third arms, the fourth arm may have any shape and configuration. A preferred form for the fourth arm is an elongate member, for example a bar or a rod. The fourth arm is pivotably mounted at a first position on the fourth arm to the second arm. The pivotable connection between the second and fourth arms may be of any suitable form, preferably a pin, spindle or axle passing through the arms about which one or both of the arms are free to move.

The fourth arm is pivotably connected to the second arm at a first position on the fourth arm and a third position on the second arm. The first position may be in any suitable location on the fourth arm. In one preferred embodiment, the first position is at or adjacent one end of the fourth arm.

The third position on the second arm is spaced apart from the first position on the second arm. In one preferred embodiment, the second position on the second arm is at or adjacent the second end of the second arm. It is particularly preferred that the third position on the second arm is coincident with the second position on the second arm, that is the third and fourth arms are pivotally connected to the second arm at the same location on the second arm.

In operation of the assembly, as noted above, the fourth arm has a point thereon that follows the path of a straight line when the assembly is moved between the retracted and the second extended positions. This point on the fourth arm is spaced apart from the first position on the fourth arm, that is the position on the fourth arm at which the second and fourth arms are pivotably connected together. The location of this point on the fourth arm will depend upon aspects of the geometry of the other components of the assembly and the location of their connections, in particular the lengths of the various arms, in particular the first and second arms and the second and third connecting arms.

The fourth arm may be a driven arm, that is moved under the action of movement of the first and second arms. In this case, rotation of the first arm about the first fixed pivot and/or the second arm about the second fixed pivot causes the fourth arm to move, such that the said point on the fourth arm follows the straight line path between the retracted and second extended positions. Alternatively, the fourth arm may be a driving arm, that is have a force applied thereto resulting in movement of the fourth arm, which in turn drives the other components of the assembly to result in movement of the first arm about the first fixed pivot and motion of the second arm about the second fixed pivot. For example, application of a straight line force to the said point on the fourth arm between the retracted and second extended positions results in rotational movement of the first and second arms about their respective fixed pivots.

Similarly, a force applied to one of the third and fourth arms, causing movement of the arm, in turn results in movement of the other of the third and fourth arms.

Taking the length of the fourth arm to be the distance between the first position on the fourth arm and the said point on the fourth arm, the length of the fourth arm will be determined by the arrangement of the first and second arms, together with the connecting arms. In some embodiments, the length of the fourth arm is less than that of the first and second arms, in particular from 0.9 to 0.99 of the length of the first and/or second arms. For example, with the first and second arms being of equal length and less than the distance between the first and second fixed pivots, the fourth arm may have a length of about 0.975 that of the first and second arms. In alternative embodiments, the length of the fourth arm is the same as that of the first arm and/or the second arm.

In one particularly preferred arrangement, the first, second and fourth arms are the same length.

The third and fourth arms may have the same or different lengths, with the third arm being longer or shorter than the fourth arm.

The assembly further comprises a third connecting arm. The third connecting arm extends between the first arm and the fourth arm. The third connecting arm may have any shape and configuration. A preferred form for the third connecting arm is an elongate member, for example a bar or a rod. The third connecting arm is pivotably mounted to each of the first and fourth arms. The pivotable connections between the first connecting arm and each of the first and fourth arms may be of any suitable form, preferably a pin, spindle or axle passing through the arms about which one or both of the arms are free to move.

The pivotable connections may be at any suitable location on the third connecting arm. In one preferred embodiment, the pivotable connection between the third connecting arm and the first arm is at or adjacent one end of the third connecting arm and/or the pivotable connection between the third connecting arm and the fourth arm is at or adjacent the second end of the third connecting arm.

The third connecting arm is connected to the first arm at a fourth position on the first arm. The fourth position on the first arm is spaced apart from the first position on the first arm. In one embodiment, the fourth position on the first arm is at or adjacent the second end of the first arm. In one preferred embodiment, the fourth position on the first arm is coincident with the second position on the first arm, that is the first and third connecting arms are pivotally connected to the first arm at the same location.

The third connecting arm is further connected to the fourth arm at a second position on the fourth arm, this second position being spaced apart from the first position on the fourth arm.

The third connecting arm may have any suitable length. Its length is preferably the distance between the positions on the first and fourth arms between which the second connecting arm extends.

The second position on the fourth arm, at which the third connecting arm is connected, may be selected according to a number of factors. First, the third connecting arm acts to provide support for the fourth arm, in particular to assist in supporting any load applied to the fourth arm. The requirement for the fourth arm to be supported in this manner by the third connecting arm is a factor in determining the location of the second position on the fourth arm. Second, the overall strength and stability of the assembly is related to the length of the third connecting arm, with the strength and stability reducing as the length of the third connecting arm increases.

The second position on the fourth arm may be at any suitable position. In particular, the ratio of the distance between the first position and the second position on the fourth arm and the distance between the first position and the said point on the fourth arm may be from 0.1 to 0.9, more preferably from 0.2 to 0.8, still more preferably from 0.3 to 0.7, in particular from 0.35 to 0.6. A preferred ratio is from 0.4 to 0.55. The ratio of the distance between the first position and the second position on the fourth arm and the distance between the first position and the said point on the fourth arm is preferably less than 0.75, more preferably less than 0.65, more preferably less than 0.55. A ratio of up to 0.5 has been found to be particularly suitable. One particularly preferred embodiment of the assembly has the ratio of the distance between the first position and the second position on the fourth arm and the distance between the first position and the said point on the fourth arm about 0.41 to about 0.47.

The second position on the fourth arm may be at the same relative location as the second position on the third arm. Preferably, the second position on the third arm is at a different relative position to the second position on the fourth arm. In this way, the third and fourth arms are at different positions at all points in movement from the retracted position.

In one preferred embodiment, the distance between the first and second positions on the fourth arm is greater than the distance between the first and second positions on the third arm. In this way, as the assembly is moved from the retracted condition, the third arm leads the fourth arm and moves ahead of the fourth to the extended position and beyond.

The ratio of the distance between the first and second positions on the fourth arm to the distance between the first and second positions on the third arm may be from 1.0 to 3.0, more preferably from 1.3 to 2.0, still more preferably from 1.5 to 2.0. A ratio of about 1.5 has been found to be particularly advantageous. Embodiments of the assembly with such a ratio may be arranged such that the said point on the fourth arm is at the second extended position, that is at the end of its path of linear motion, when the third arm is substantially perpendicular to the line extending between the first and second fixed pivots.

In general, the arms and connecting arms of the lever assemblies move parallel to one another. In other words, the arms and connecting arms may each be considered to move in a plane that is coincident with or parallel to the plane of one or more of the other arms and connecting arms. In use, a number of the arms and connecting arms cross one another. It is advantageous if the arms or connecting arms that cross in this manner are slidably connected to one another. In particular, a first arm or connecting arm that crosses a second arm or connecting arm may be slidably connected to the second arm or connecting arm. For example, a first arm or connecting arm is provided with a member that slides therealong, the member being connected, preferably pivotally connected, to a second arm or connecting arm that crosses the first in use. In this way, the rigidity of the two arms so interconnected is increased, in particular increasing the lateral stability of the arms and preventing their movement out of the normal plane of movement.

In one preferred embodiment, the first arm is slidably connected to the second arm. More particularly, one of the first and second arms is preferably provided with a member that slides therealong. The member is pivotally connected to the other of the first and second arms. In one preferred arrangement, the sliding member is mounted on the second arm.

The assembly may comprise further arms and respective connecting arms, arranged as described above in respect of the third arm and first connecting arm and the fourth arm and third connecting arm. Thus, the assembly may comprise a fifth arm and a fourth connecting arm, each arranged in an analogous manner to that of the fourth arm and third connecting arm, as described hereinbefore. The second position on the fifth arm is at a different relative location on the arm to the second position of both the third and fourth arms. This ensures the fifth arm is at a different position and orientation to both the third and fourth arms, as described hereinbefore. Similarly, the assembly may comprise a sixth arm and fifth connecting arm, also arranged in analogous manner.

Relative movement of the components of the assembly may be limited or restricted, for example to limit the movement of the third arm such that the motion of the said point is confined to a straight line between the retracted and extended positions. Suitable means for limiting the relative movement of components of the assembly include a flexible tie or tether extending between two of the arms or connecting arms. In one embodiment, a flexible tie or tether extends between the first arm and the third arm or the fourth arm, in particular between a point on the first arm between the first and fourth positions thereon and the first position on the third arm or the fourth arm. One preferred form for the flexible tie comprises a plurality of hingedly connected arms or arm assemblies moveable between a folded condition when the assembly is in the retracted position and a fully extended condition in an extended position.

In one preferred embodiment, the third arm of the lever assembly is connected to and moves the roof portion of the building assembly between its retracted position and its extended position. The fourth arm is connected to one or more other components of the building assembly for movement between the retracted and extended positions. In one preferred arrangement, the fourth arm is connected to and moves a floor assembly between a retracted and an extended position. In this embodiment, the movement of the lever assembly and the fourth arm is preferably restricted, such that the movement of the said point on the fourth arm is limited to a linear motion. The floor assembly may act as the limiter of the movement of the lever assembly in general and the fourth arm in particular, with the limit of the movement of the assembly into the extended position being the position in which the floor assembly is fully deployed.

The lever assembly may be driven by any suitable means, as noted above. In one preferred embodiment, the lever assembly is driven by a manually operated jack.

The lever assembly preferably comprises further linkages to other components of the building assembly, if present. For example, the lever assembly preferably comprises appropriate linkages, such as rods, levers, cables or the like, to move any wall portions or floor portions that may be present.

A single lever assembly may be provided to support and move the roof portion of the building assembly. More preferably, in particular for larger roof portions, a plurality of lever assemblies are provided, the lever assemblies being operable in unison. For example, in one preferred arrangement, the roof portion is provided with a lever assembly at each lateral edge thereof, that is each edge extending outwards from the building structure in the direction of movement of the roof portion.

The building assembly of the present invention may be a stand alone structure, for example to provide a temporary free standing roof. Alternatively, the assembly may be provided as part of a larger building structure, either temporary or permanent.

Accordingly, in a further aspect, the present invention provides a building comprising a building assembly as hereinbefore described.

The building may comprise a single building assembly. Alternatively, the building may comprise a plurality of building assemblies spaced around its footprint. In the case of a multi-story building the assemblies may be at the same or different elevations on the building.

Figure 1B:
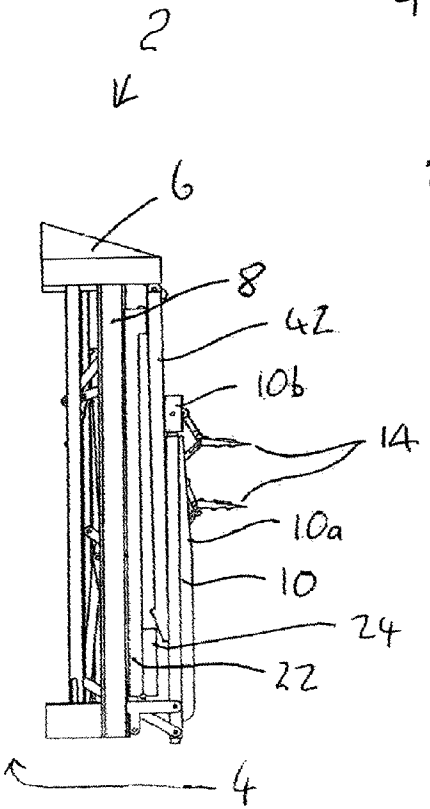

Embodiments of the present invention will now be described, by way of example only, having reference to the accompanying drawings, in which:

FIG. 1*a* is a perspective view of a building assembly according to one embodiment of the present invention in a retracted condition employing a first embodiment of a lever assembly;

FIG. 1*b* is a side view of the assembly of FIG. 1*a;*

Figure 2A:
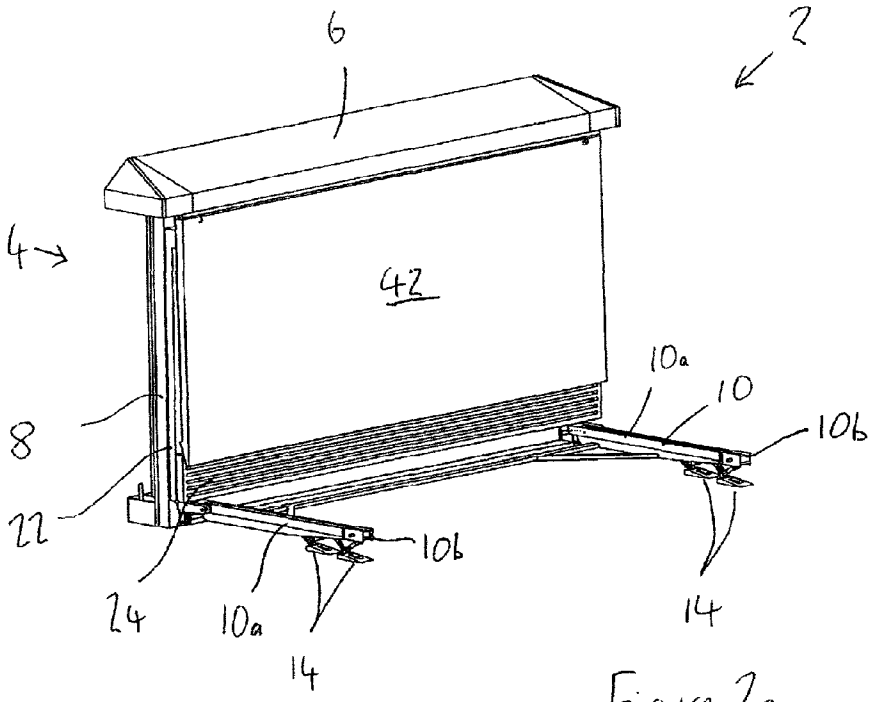
Figure 2B:
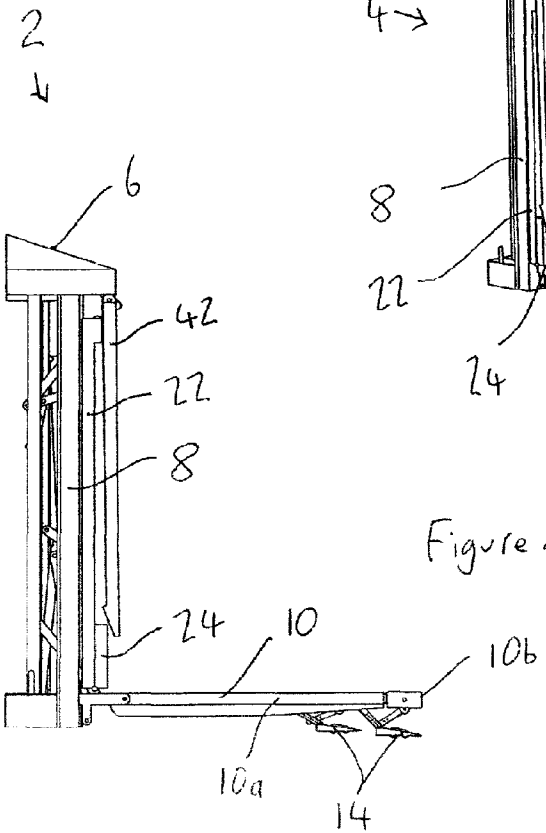

FIG. 2*a* is perspective view of the assembly of FIG. 1*a* in a first partially extended condition;

FIG. 2*b* is a side view of the assembly of FIG. 2*a;*

Figure 3A:
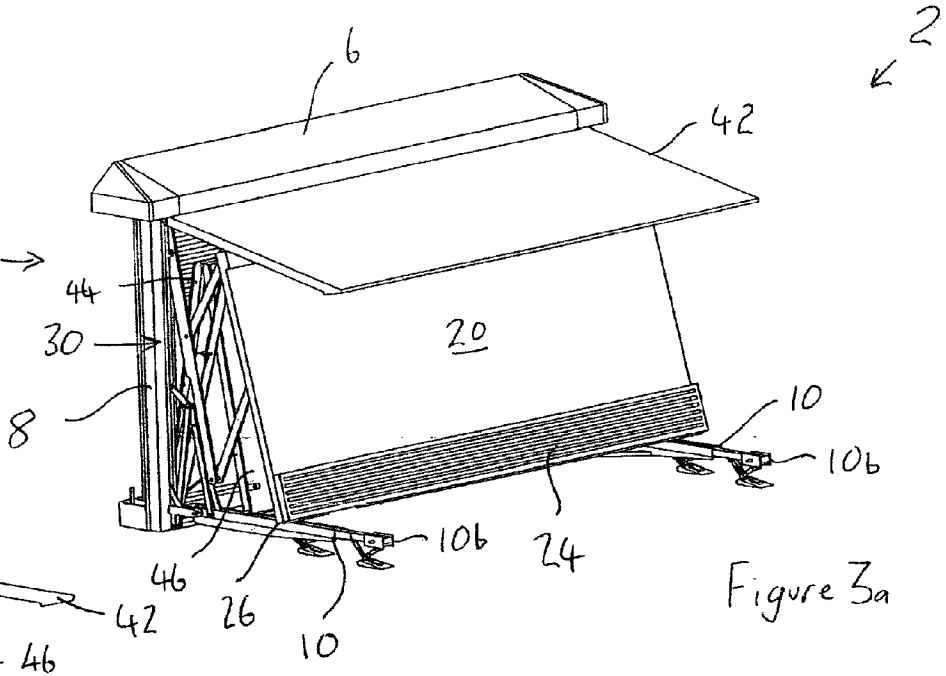
Figure 3B:
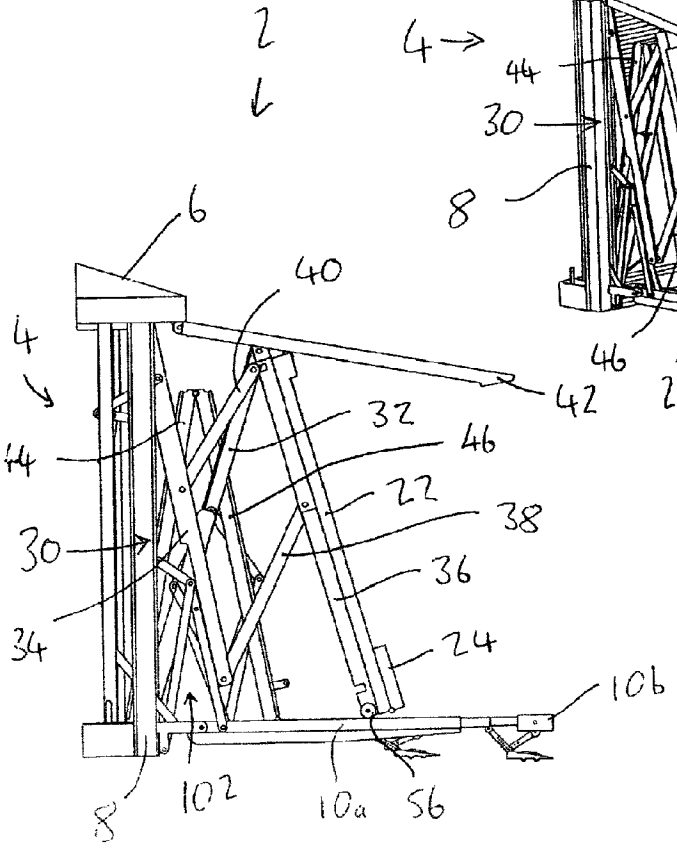

FIG. 3*a* is perspective view of the assembly of FIG. 1*a* in a second partially extended condition;

FIG. 3*b* is a side view of the assembly of FIG. 3*a;*

Figure 4A:
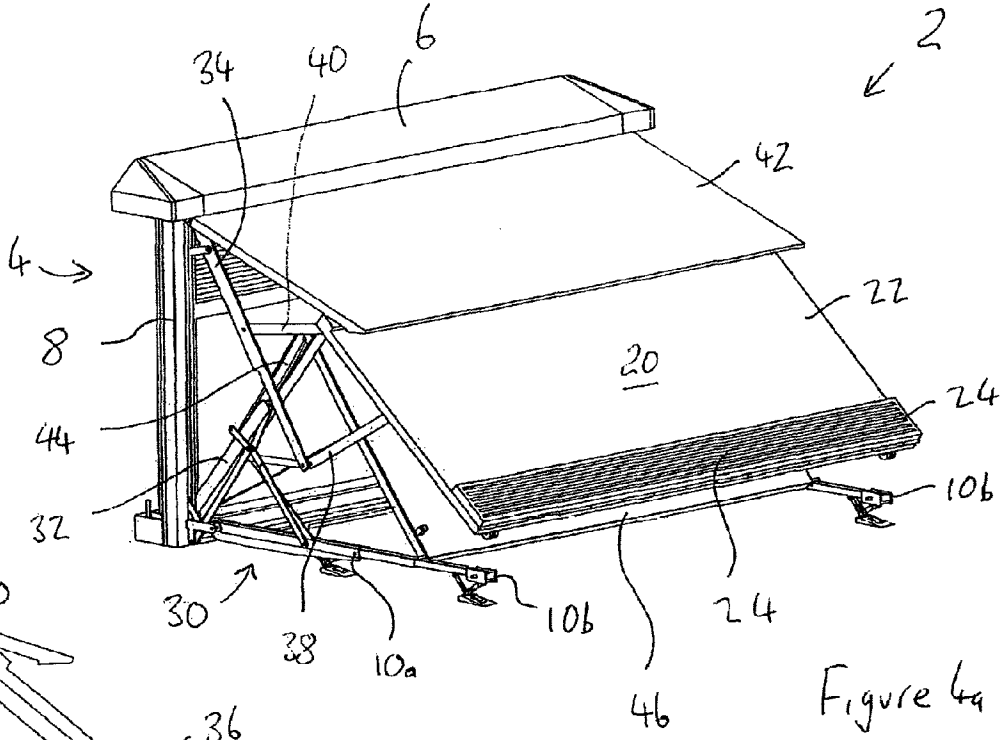
Figure 4B:
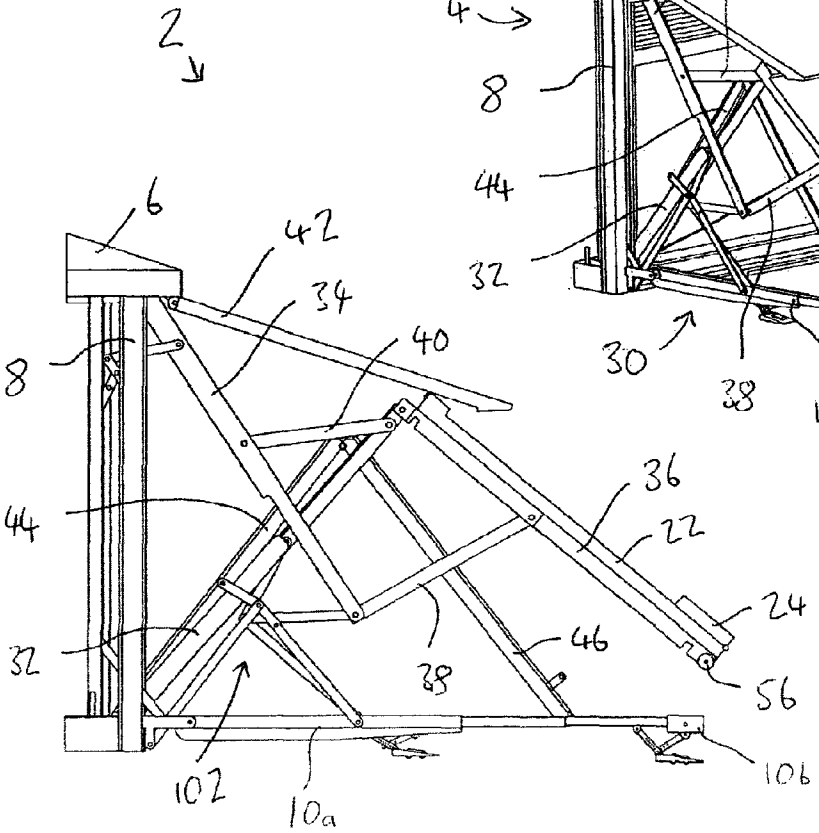

FIG. 4*a* is perspective view of the assembly of FIG. 1*a* in a third partially extended condition;

FIG. 4*b* is a side view of the assembly of FIG. 4*a;*

Figure 5A:
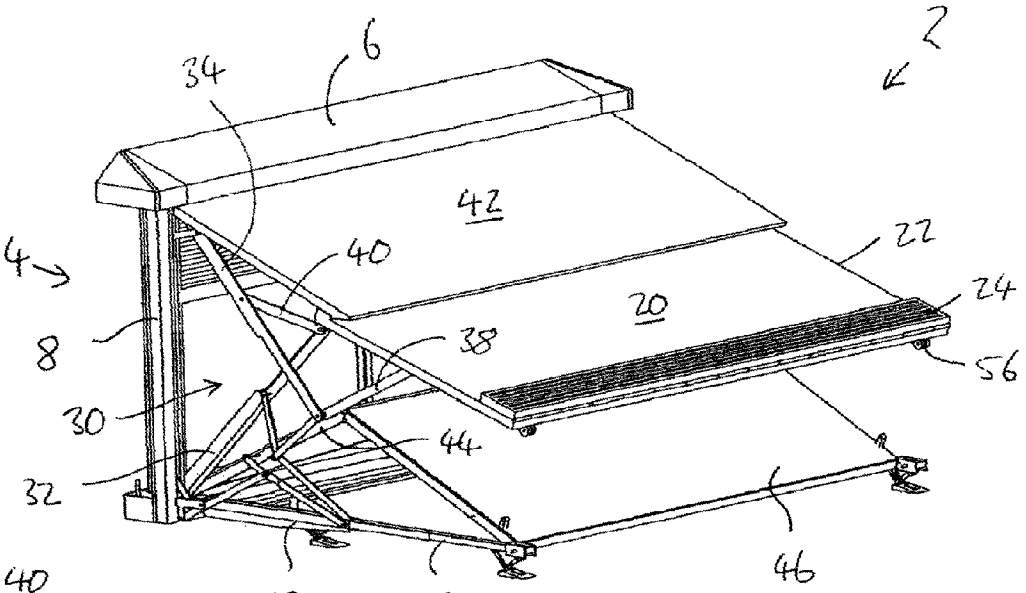
Figure 5B:
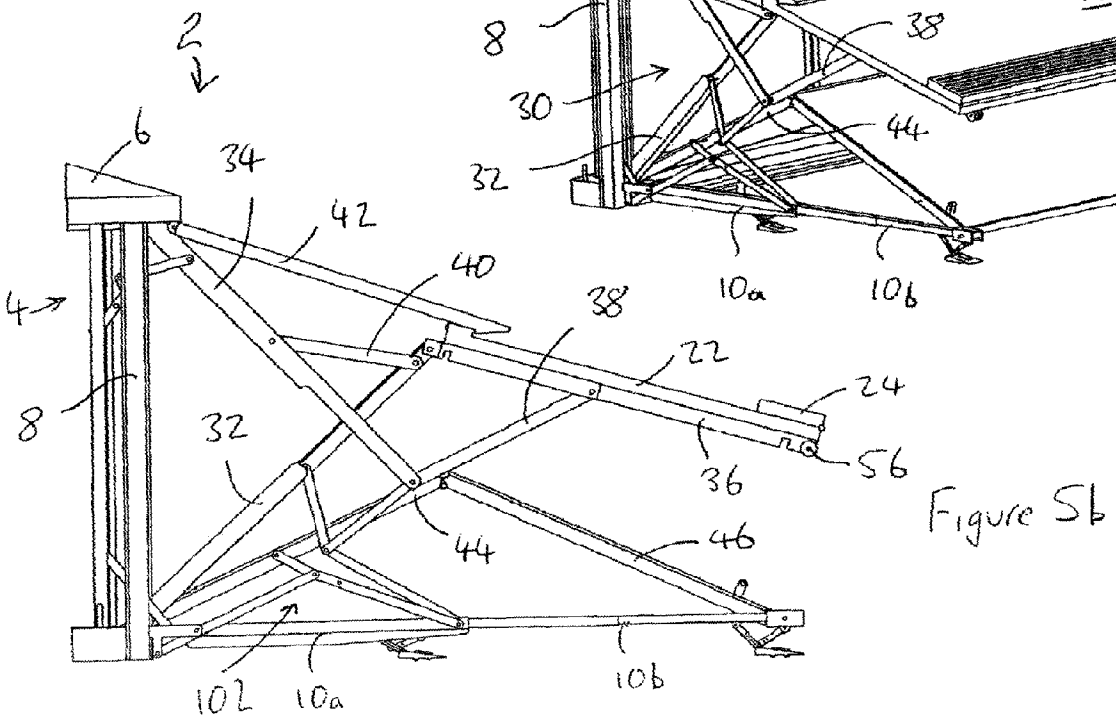

FIG. 5*a* is perspective view of the assembly of FIG. 1*a* in a fourth partially extended condition;

FIG. 5*b* is a side view of the assembly of FIG. 5*a;*

Figure 6A:
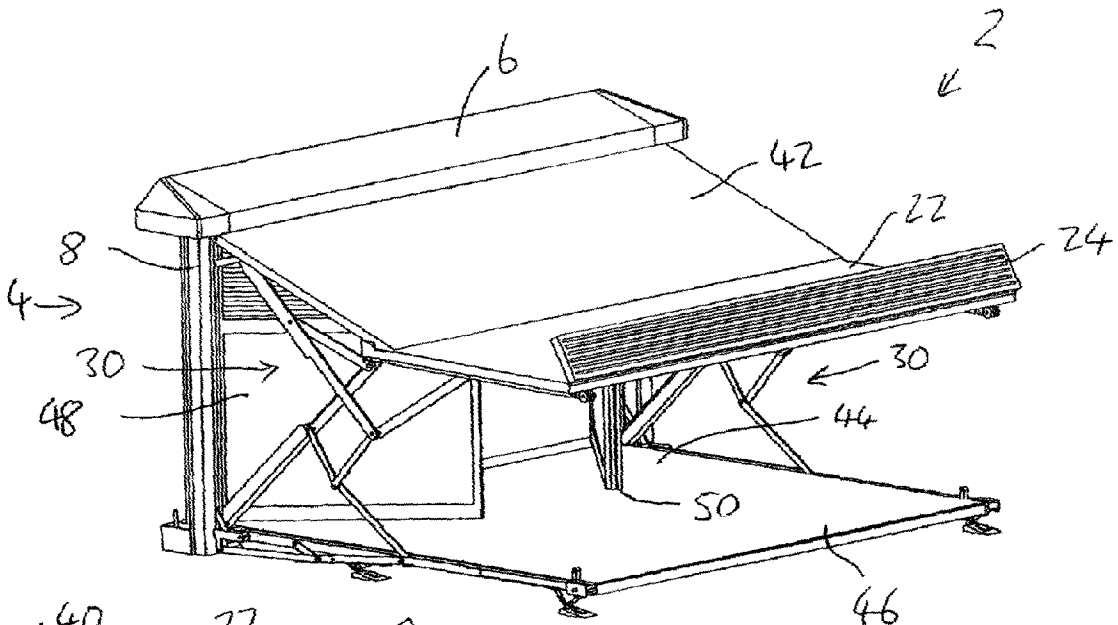
Figure 6B:
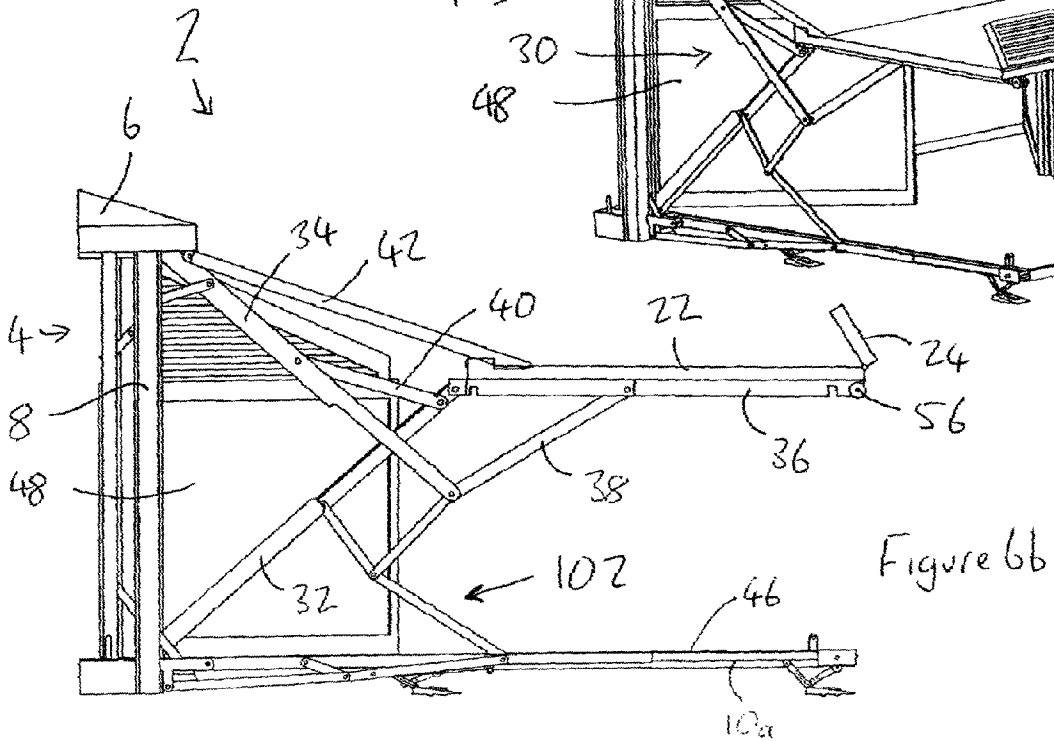

FIG. 6*a* is perspective view of the assembly of FIG. 1*a* in a fifth partially extended condition;

FIG. 6*b* is a side view of the assembly of FIG. 6*a;*

Figure 7A:
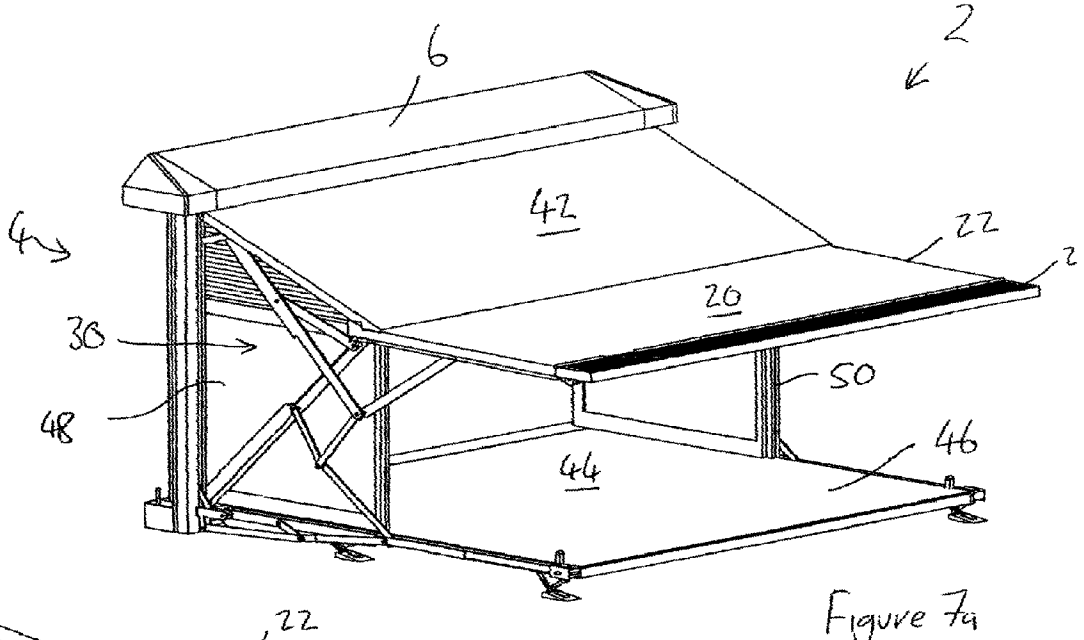
Figure 7B:
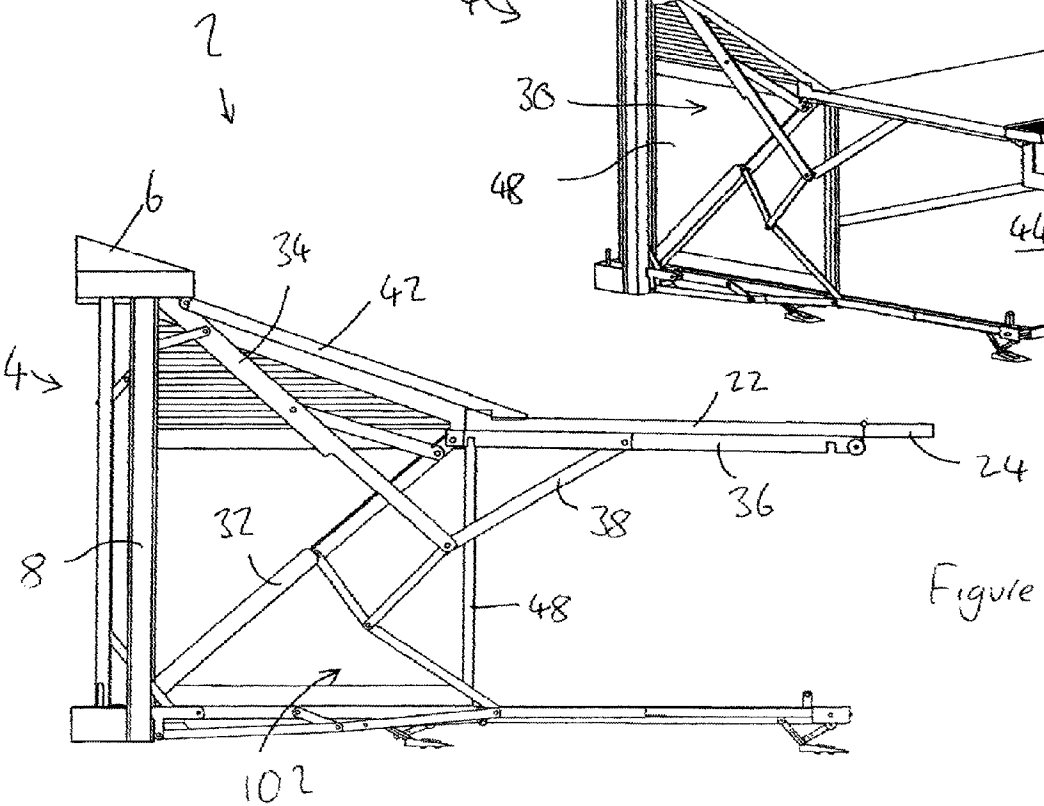

FIG. 7*a* is perspective view of the assembly of FIG. 1*a* in an extended condition;

FIG. 7*b* is a side view of the assembly of FIG. 7*a;*

Figures 8A, 8B:
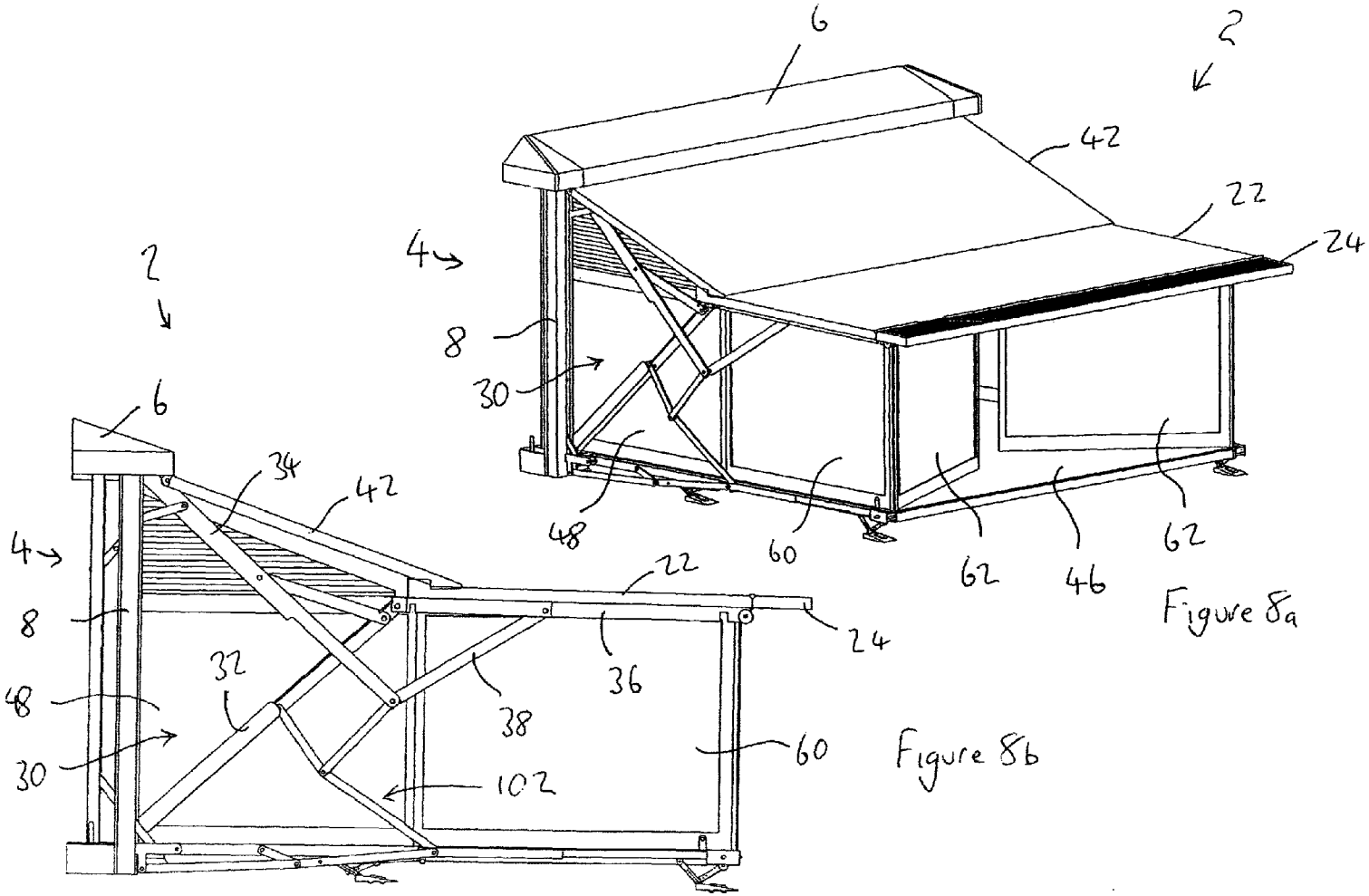

FIG. 8*a* is a perspective view of the assembly of FIG. 7*a* with additional side panels;

FIG. 8*b* is a side view of the assembly of FIG. 8*a;*

Figure 9:
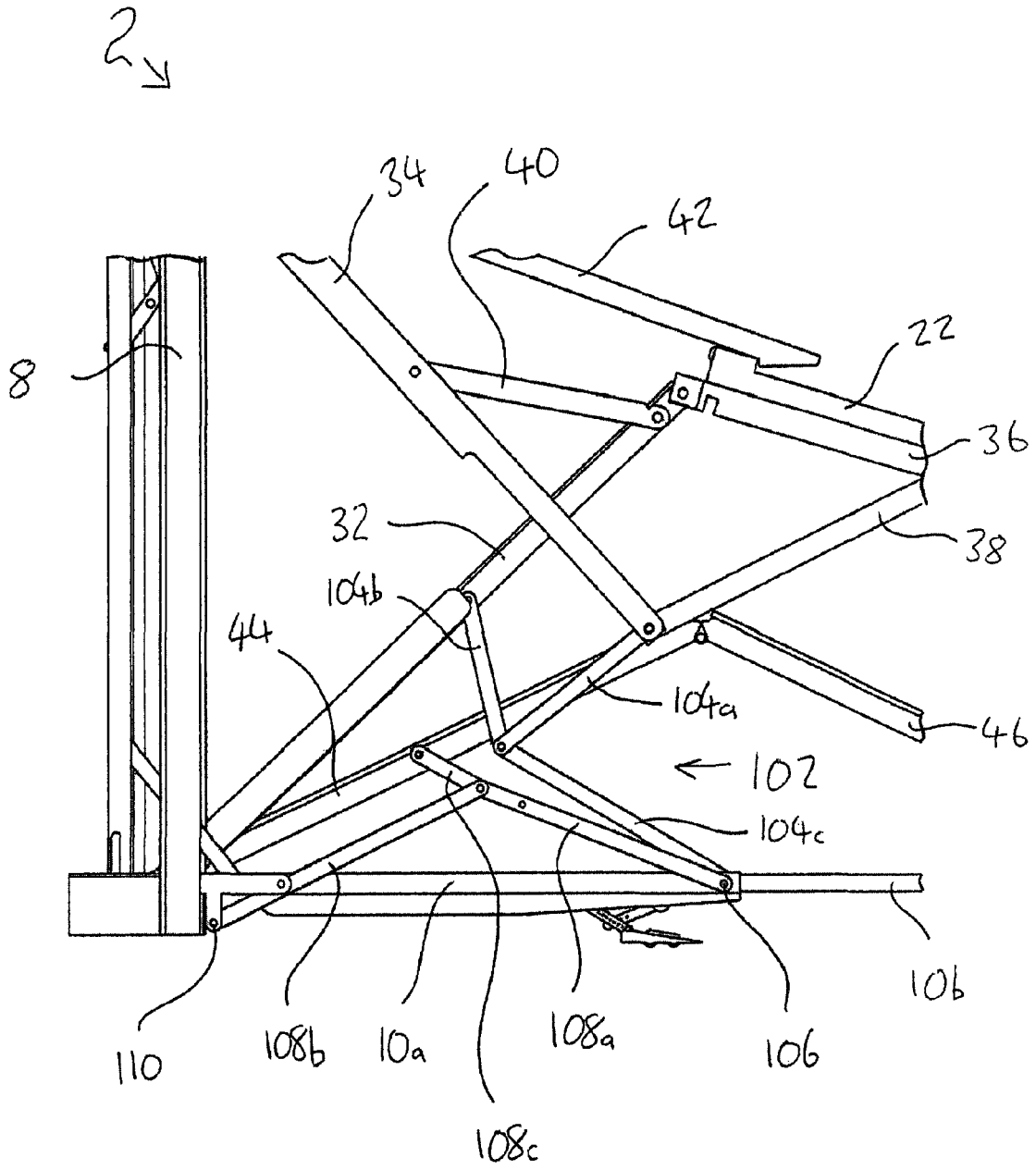
Figure 10:
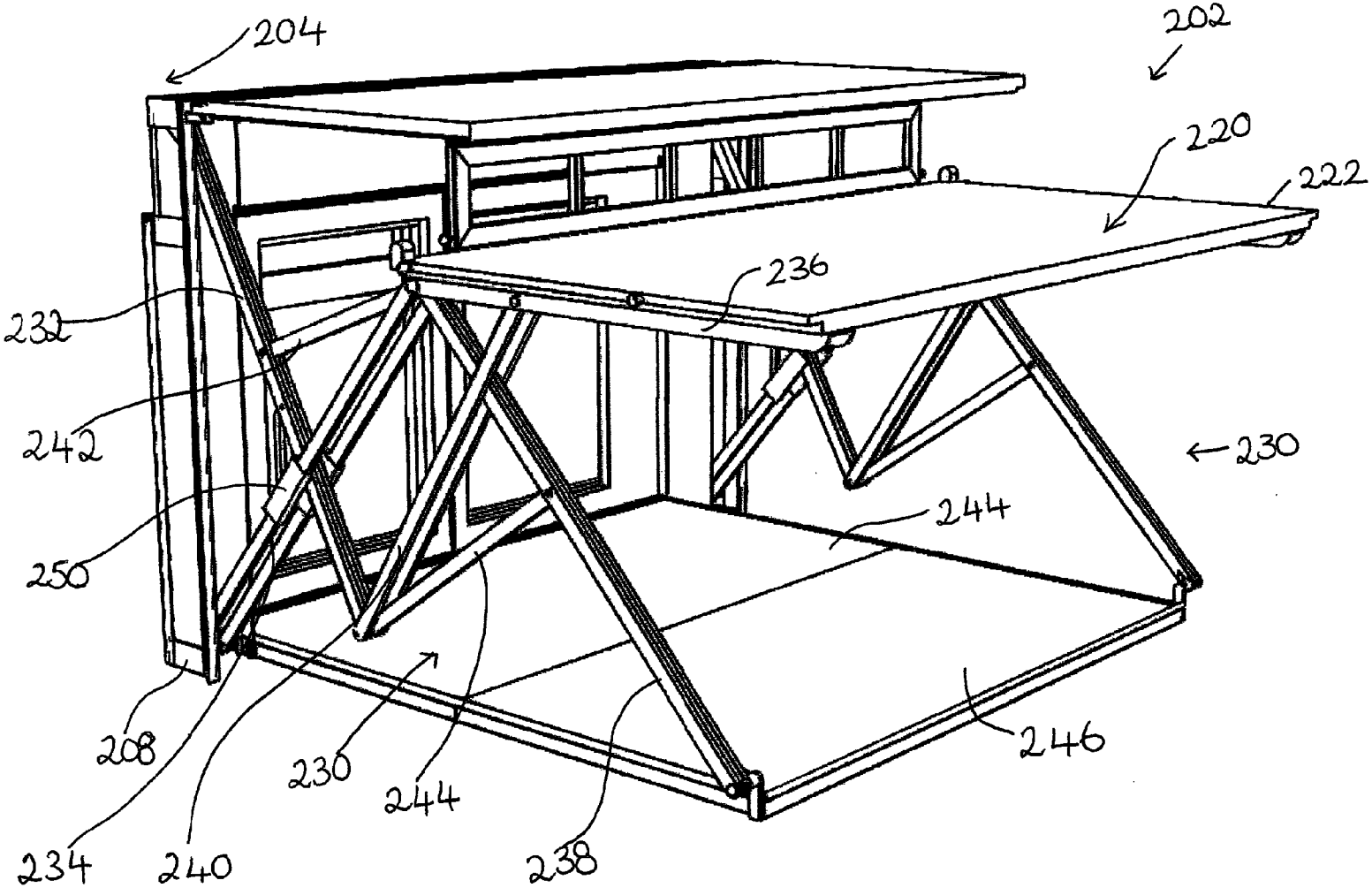

FIG. 9 is an enlarged view of a portion of the assembly as shown in FIG. 5; and FIG. 10 is a perspective side view of an alternative embodiment of the building assembly employing a second embodiment of a lever assembly.

Turning to the figures, there is shown a building assembly according to one embodiment of the present invention, generally indicated as 2. The assembly 2 is shown mounted to a building structure, generally indicated as 4, and having a roof 6. The building assembly 2 is mounted within an opening in a wall of the building 4 having a frame 8 supporting the assembly 2.

The building assembly 2 comprises a pair of spaced apart support beams 10, interconnected by a frame 12. Each support beam comprises two beam portions 10*a*, 10*b*, arranged telescopically, such that the beam portion 10*b* moves within the beam portion 10*a*, as shown for example in FIGS. 3 and 4. Each beam portion 10*a*, 10*b* is provided with a foldable foot 14. Each support beam 10 is pivotally mounted at one end to the base of the frame 8. In the retracted position, shown in FIGS. 1*a* and 1*b*, the support beams 10 are in a vertical position.

The assembly 2 further comprises a roof portion 20. The roof portion 20 is a rigid, planar structure comprising a roof panel 22. Roof extension 24 is hingedly mounted to the distal edge 26 of the roof panel 22.

The roof portion 20 is supported by a lever assembly, generally indicated as 30. The lever assembly 30 is a five lever assembly as generally described hereinbefore and described and shown in GB1209982.6. A lever assembly 30 is provided on each lateral side of the roof portion 20. The lever assembly 30 is pivotally mounted to the frame 8, with pivot connections at the top and bottom of the vertical members of the frame 8. The lever assembly 30 comprises a first arm 32, a second arm 34 and a third arm 36. The first arm 32 extends from the pivot connection at the lower end of the frame 8, while the second arm extends from the pivot connection at the top end of the frame 8. First and second connecting arms 38, 40 extend between the second and third arms and the first and second arms, respectively. The roof portion 20 is mounted to the third arm 36.

Levers connect the beam portions 10*b* to the lever assembly 30, such that the action of the lever assembly in moving the roof portion 20 also extends the support beams 10 by moving the beam portions 10*b* outwards from the beam portions 10*a*.

The assembly 2 further comprises an intermediate portion 42. The intermediate portion is a generally planar, rigid member hingedly attached to the top of the frame 8 of the building 4.

First and second floor portions 44, 46 are provided, the first floor section 44 is hingedly mounted at one edge to the lower portion of the frame 8 of the building and at the opposite edge to the second floor portion 46. Levers connect the floor sections 44, 46 to the lever assembly 30, such that the action of the lever assembly in moving the roof portion 20 also deploys the floor sections.

Further, the assembly 2 includes first and second wall portions 48, 50, shown in FIGS. 6 and 7. Each wall portion 48, 50 is hinged along a vertical edge to the frame 8 of the building 4. The wall portions may comprise window and door openings, as required. Levers connect the wall portions 48, 50 to the lever assembly 30, such that the action of the lever assembly in moving the roof portion 20 also deploys the wall portions.

The operation of the assembly 2 is shown in stages from the retracted condition in FIGS. 1*a* and 1*b*, to an extended condition in FIGS. 7*a* and 7*b*. Operation of the system is as follows:

In the retracted condition of the assembly 2 shown in FIGS. 1*a* and 1*b*, the components of the assembly are generally arranged in a vertical orientation within the perimeter of the roof 6 of the building 4. In particular, the roof portion 20 extends vertically against the frame 8 of the building 4. The intermediate portion 42 also extends vertically and overlies the roof portion 20. The floor portions 44, 46 are folded vertically on the interior side of the roof portion. The wall portions 48, 50 lie on the interior side of the floor portions. The support beams 10 are stowed and extend upright from the lower part of the frame 8.

As shown in FIGS. 2*a* and 2*b*, the support beams 10 are lowered to a horizontal position with the feet 14 contacting the ground.

Thereafter, referring to FIGS. 3*a* and 3*b*, the lever assembly 30 is activated to move the roof portion 20. Activation of the lever assembly 30 is by way of a manually operated jack (not shown for clarity) acting on the first arm 32 and/or the second arm 34. The action of the lever assembly 30 is to move the floor portion 20 outwards and away from the frame 8 of the building 4. This movement displaces the roof portion 20 and initialises a rotation of the roof portion. The free end of the third arm 36 and the distal edge 26 of the roof panel 22 is initially moved in a straight line along the support beams 10. A wheel 56 mounted on the free end of the third arm 36 bears on the upper surface of the respective beam 10, which acts to guide the movement of the roof portion 20.

As shown in FIG. 3*a*, the upper edge of the roof panel 22 bears on the inner/lower surface of the intermediate portion 42. The action of the lever assembly 30 in moving the roof portion 20 outwards along the support beams 10 also urges the intermediate portion 42 upwards, pivoting about the upper portion of the frame 8 of the building.

Referring to FIGS. 4*a* and 4*b*, after the initial phase of movement of the lever assembly 30, during which the distal edge 26 of the roof panel 22 moves in a substantially straight line along the support beams 10, continued movement of the lever assembly 30 moves the roof portion 20 such that the roof panel 22 moves outwards and upwards in an arc.

As also shown in FIGS. 4*a* and 4*b*, the floor sections 44, 46 are being unfolded along the support beams 10.

The further movement of the lever assembly 30 and the components of the assembly 2 is shown in FIGS. 5*a* and 5*b*.

Further action of the lever assemblies 30 moves the roof portion 20 to a position in which the roof panel 22 is substantially horizontal position, as shown in FIGS. 6*a* and 6*b*. It will be appreciated that movement of the roof portion may be stopped with the roof panel 22 extending at an angle to the horizontal, for example to provide the roof of the building with a pitch, allowing for the free drainage of rain water and the like.

In the condition shown in FIGS. 6*a* and 6*b*, the intermediate portion 42 is interlocked at its distal edge with the edge of the roof panel 22, thereby forming a water tight seal. In this position, the area of the roof of the building 4 has been extended by the total area of the intermediate portion 42 and the roof panel 22. The roof extension 24 is unfolded, as shown in FIG. 6*b*.

Further, as shown in FIGS. 6*a* and 6*b*, the floor sections 44, 46 are fully extended and horizontal, supported on the support beams 10. The floor sections extend the floor area of the building 4.

The wall portions 48, 50 are shown in FIGS. 6*a* and 6*b* being moved from their stowed position outwards about their hinges. The wall portions 48, 50 are shown in their final position in FIGS. 7*a* and 7*b*.

Referring to FIGS. 8*a* and 8*b*, the assembly 2 may be provided with additional side panels 60, 62. The additional side panels 60, 62 are hingedly attached along a vertical edge to each other and to the side panels 48. As shown in FIGS. 8*a* and 8*b*, the side panels 48, 60, 62 unfold to provide a complete wall enclosure between the roof portion 20 and the floor sections 44, 46. As before, the additional side panels 60, 62 may be provided with window and/or door openings, as required.

As noted in the general description above, two or more components of the assembly may be interconnected, such that movement of one component causes one or more other components to be moved. The embodiment shown in the accompanying figures is arranged to have the floor sections 44, 46 interconnected so at to at least partly counterbalance the roof portion 20. Details of this interconnection and its operation are shown in FIG. 9, and are as follows:

Referring to FIG. 9, a lever assembly, generally indicated as 102, is provided between each of the first arm 32 and the second arm 34 and the floor section 44. The lever assembly 102 comprises first pivotally connected levers 104*a*, 104*b*, 104*c*, extending from pivoted connections on the first arm 32 and the second arm 34 to a sliding pivoted mount 106 on the beam portion 10*a*. Second pivotally connected levers 108*a*, 108*b*, 108*c* extend from the sliding pivoted mount 106 and a fixed pivoted mount 110 to a pivoted connection on the floor section 44. This arrangement of the first and second levers 104*a*, 104*b*, 104*c* and 108*a*, 108*b*, 108*c* is shown most clearly in its stages of operation in FIGS. 4 to 6.

In operation, the roof portion 22 moves from its vertical, stowed position as shown in FIGS. 1 and 2 along the beam portions 10*a* and 10*b*, as shown in FIG. 3. The roof portion 22 is connected to the floor section 44 by means of the first and second arms 32, 34 and the lever assembly 102. As a result, movement of the roof portion 22 causes the floor section 44 and the attached floor section 46 to move outwards from their vertical stowed positions. Movement of the roof portion 22 beyond the end of the beam portion 10*b* requires the roof portion 22 to be raised, as shown in FIGS. 4 and 5. The floor sections 44 and 46 are urged downwards under the action of gravity. This acts as a driving force, which is provided to the roof portion 22 by means of the lever assembly 102 and acts to urge the roof portion 22 upwards, as shown in FIGS. 4 to 6. By appropriate selection of the relative weights of the roof portion 22 and the floor sections 44, 46 these components may be counterbalanced sufficiently to significantly reduce the power required to be input into the system to move the components. In particular, the components may be arranged to allow for manual operation.

Movement of the components in the reverse direction from the extended or deployed position of FIG. 8 to the stowed position of FIG. 1 is also possible. In this case, the sequence of events is the reverse of that shown in the figures and as described above. In particular, the weight of the roof portion 22 may be used to raise the floor sections 44 and 46 into their vertical, stowed position, in the reverse of the action described above.

Turning to FIG. 10, there is shown a further embodiment of a building assembly of the present invention. The building assembly, generally indicated as 202, is shown mounted to a building structure, generally indicated as 204. The building assembly 202 is mounted within an opening in a wall of the building 204 having a frame 208 supporting the assembly 202. The assembly 202 has the same general configuration as described above and shown in FIGS. 1 to 9. In particular, the assembly 202 further comprises a roof portion 220. The roof portion 220 is a rigid, planar structure comprising a roof panel 222.

The roof portion 220 is supported by a pair of lever assemblies, generally indicated as 230. The lever assembly 230 is a seven lever assembly as generally described hereinbefore and described and shown in GB1214929.0. A lever assembly 230 is provided on each lateral side of the roof portion 220. The lever assembly 230 is pivotally mounted to the frame 208, with pivot connections at the top and bottom of the vertical members of the frame 208. The roof portion 220 is connected to the lever assemblies 230 as described below.

First and second floor portions 244, 246 are provided, the first floor section 244 is hingedly mounted at one edge to the lower portion of the frame 208 of the building and at the opposite edge to the second floor portion 246. The first and second floor portions 244, 246 form a floor assembly, which is connected to the lever assemblies 230 as described below.

The lever assembly 230 comprises a first arm 232, a second arm 234, a third arm 236 and a fourth arm 238. The first arm 232 extends from a pivot connection at the upper end of the frame 208, while the second arm extends from a pivot connection at the lower end of the frame 208. The third and fourth arms 236, 238 are pivotally connected to the end of the second arm 234. A first connecting arm 240 extends between the end of the first arm 232 to the third arm 236. A second connecting arm 242 extends between the first arm and the second arm. A third connecting arm 244 extends between the end of the first arm and the fourth arm, as shown in FIG. 10.

The roof portion 220 is mounted to the third arm 236. The second floor portion 246 is pivotally mounted to the end of the fourth arm of each lever assembly 230.

The building assembly 202 is shown in FIG. 10 in an extended position corresponding to that of FIG. 6*a* described above. In particular, both the floor portions 244, 246 and the roof portion 220 are fully deployed into their extended positions. The operation of the assembly is generally the same as described above and shown in FIGS. 1 to 9. In particular, the action of the lever assemblies 230 is to move the roof portion 220 from a retracted position (corresponding to that shown in FIG. 1), in which the roof portion 220 is disposed vertically and within the frame 208, to the extended position shown in FIG. 10, in which the roof portion is displaced from the frame 208 and extends substantially horizontally. It will be appreciated that the action of the lever assemblies 230 in moving the roof portion from the retracted position to the extended position shown in FIG. 10 is both to displace and rotate the roof portion 220.

At the same time, the floor assembly is deployed. In particular, the fourth arm 238 is moved to the position shown in FIG. 10. The first and second floor portions 244, 246 are hinged and folded when in the retracted position, as described above with respect to the embodiment of FIGS. 1 to 9. The action of the fourth arm 238 moving from the retracted position is to unfold the first and second floor portions 244, 246 to the deployed position, in which the floor portions 244, 246 form a horizontal floor below the roof portion 220, as shown in FIG. 10. Movement of the fourth arm 238, and hence the other arms of the lever assemblies 230 and the components connected thereto, is prevented by the floor portions 244, 246.

Movement of the assembly 202 from the extended position to the retracted position is the reverse. As noted above, the weight of the roof portion 220 may be used to assist in raising the floor portions 244, 246 into the retracted position.

To provide increased stability to each of the lever assemblies 230, a slider 250 is provided on the second arm, the slider able to slide along the second arm. The slider 250 is pivotally connected to the first arm 232, such that the movement of the first and second arms 232, 234 is linked.

The invention claimed is:

1. An expandable building assembly, the building assembly having a retracted condition, in which the roof of the building has a first area, and an extended condition, in which the roof of the building has a second area, the second area being greater than the first, the assembly comprising:

a roof portion having a distal edge; and means for displacing and rotating the roof portion between the retracted condition and the expanded condition;

whereby in the retracted condition, the roof portion is in a first position and at a first orientation, and in the extended condition, the roof portion is in a second position and at a second orientation, wherein the second position is displaced from the first position and the second orientation is rotated with respect to the first orientation:

wherein the roof portion is substantially vertical in the first position; and wherein the distal edge of the roof portion in moving from the retracted condition to the extended condition moves in a first linear path and thereafter in a second arcuate path.

2. The assembly according to claim 1, wherein the assembly has a footprint and, in the first position, the roof portion lies within the footprint of the assembly.

3. The assembly according to claim 2, wherein the roof portion forms a portion of a wall of the assembly when in the first position.

4. The assembly according to claim 1, wherein the assembly has a footprint and in the second position the roof portion lies at least partially outside the footprint of the assembly.

5. The assembly according to claim 1, wherein in the extended condition, an intermediate portion extends between the roof portion and other components of the assembly.

6. The assembly according to claim 5, wherein the intermediate portion forms at least a portion of an outer wall of the assembly when in the retracted condition.

7. The assembly according to claim 5, wherein the extended condition, the roof portion and the intermediate portion interlock.

8. The assembly according to claim 1, further comprising one or more wall portions, the or each wall portion moveable between the retracted and extended conditions.

9. The assembly according to claim 8, wherein the one or more wall portions unfold when moving from the retracted condition to the extended condition.

10. The assembly according to claim 8, wherein the assembly has a footprint and the wall portions lie within the footprint of the assembly when in the retracted condition.

11. The assembly according to claim 1, further comprising a floor assembly, the floor assembly moveable between the extended condition and the retracted condition.

12. The assembly according to claim 11, wherein the floor assembly forms a floor beneath the entire roof portion, when the roof portion is in the extended condition.

13. The assembly according to claim 11, wherein the floor assembly unfolds in moving from the retracted condition to the extended condition.

14. The assembly according to claim 11, wherein the floor assembly comprises one or more floor portions, the or each floor portion being substantially vertical when in the retracted condition.

15. The assembly according to claim 1, wherein two or more components of the assembly are interconnected by a lever assembly, the lever assembly comprising:

a first arm rotatable at a first position thereon about a first fixed pivot;

a second arm rotatable at a first position thereon about a second fixed pivot, the second fixed pivot spaced apart from the first fixed pivot;

a third arm pivotably connected at a first position thereon to the second arm at a second position on the second arm, the second position spaced apart from the first position on the second arm;

a first connecting arm extending between the first arm and the third arm, the first connecting arm pivotably connected to a second position on the first arm spaced apart from the first position and pivotably connected to the third arm at a second position thereon spaced apart from the first position thereon; and a second connecting arm extending between the first arm and the second arm, the second connecting arm pivotably connected to a third position on the first arm disposed between the first and second positions thereon and pivotably connected to a third position on the second arm at a third position thereon.

16. The assembly according to claim 1, wherein two or more components are interconnected by a lever assembly, the lever assembly comprising:

a first arm rotatable at a first position thereon about a first fixed pivot;

a second arm rotatable at a first position thereon about a second fixed pivot, the second fixed pivot spaced apart from the first fixed pivot;

a third arm pivotably connected at a first position thereon to the second arm at a second position on the second arm, the second position spaced apart from the first position on the second arm;

a fourth arm pivotably connected at a first position thereon to the second arm at a third position on the second arm;

a first connecting arm extending between the first arm and the third arm, the first connecting arm pivotably connected to a second position on the first arm spaced apart from the first position and pivotably connected to the third arm at a second position thereon spaced apart from the first position thereon;

a second connecting arm extending between the first arm and the second arm, the second connecting arm pivotably connected to a third position on the first arm disposed between the first and second positions thereon and pivotably connected to a fourth position on the second arm at a third position thereon; and a third connecting arm extending between the first arm and the fourth arm, the third connecting arm pivotably connected to a fourth position on the first arm and pivotably connected to a second position on the fourth arm.

17. The assembly according to claim 1, wherein movement of a first component of the assembly is at least partially counterbalanced by movement of a second component of the assembly.

18. The assembly according to claim 17, wherein the first component is the roof portion.

19. The assembly according to claim 17, wherein the second component is one or more floor portions.

20. A method of changing the roof of a building between a retracted condition, in which the roof has a first area, and an expanded condition, in which the roof has a second area, the second area greater than the first area, the method comprising:

providing a roof portion of the building, the roof portion comprising a distal edge and having a first position and a first orientation in the retracted condition and a second position and a second orientation in the expanded condition;

wherein the roof portion is substantially vertical in the first position;

wherein when in the second position the roof portion is displaced from its first position and when in the second orientation the roof portion is rotated relative to its first orientation;

the method comprising displacing the roof portion between the first position and the second position and rotating the roof portion between the first orientation and the second orientation; wherein the distal edge of the roof portion in moving from the retracted condition to the extended condition moves in a first linear path and thereafter in a second arcuate path.

* * * * *